US008480220B2

(12) United States Patent
Mizuno et al.

(10) Patent No.: US 8,480,220 B2
(45) Date of Patent: Jul. 9, 2013

(54) INK CARTRIDGE

(75) Inventors: Naoki Mizuno, Nagoya (JP); Yutaka Takagiwa, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 13/337,693

(22) Filed: Dec. 27, 2011

(65) Prior Publication Data

US 2012/0162329 A1 Jun. 28, 2012

(30) Foreign Application Priority Data

Dec. 28, 2010 (JP) ..... 2010-293353
Dec. 28, 2010 (JP) ..... 2010-293360
Dec. 28, 2010 (JP) ..... 2010-293364
Dec. 28, 2010 (JP) ..... 2010-293367

(51) Int. Cl.
*B41J 2/175* (2006.01)

(52) U.S. Cl.
USPC ..... 347/86

(58) Field of Classification Search
USPC ..... 347/86
See application file for complete search history.

(56) References Cited

U.S. PATENT DOCUMENTS 3,430,824 A 3/1969 Conners et al.
4,695,824 A * 9/1987 Tazaki ..... 347/86
6,554,402 B2 4/2003 Trafton et al.
6,695,757 B2 2/2004 Edwards et al.
6,837,576 B2 1/2005 Whitlock et al.
6,851,799 B2 2/2005 Trafton et al.
6,908,182 B2 6/2005 Nakazawa et al.
7,144,104 B2 12/2006 Katayama
7,152,965 B2 12/2006 Ishizawa et al.
7,192,127 B2 3/2007 Kudo et al.
7,229,163 B2 6/2007 Shimizu et al.
7,237,880 B2 7/2007 Miyazawa et al.
7,469,992 B2 12/2008 Suzuki et al.
7,722,174 B2 5/2010 Kimura et al.

(Continued)

FOREIGN PATENT DOCUMENTS

JP 2006-240131 A 9/2006

OTHER PUBLICATIONS

Related U.S. Appl. No. 13/337,643, to Kobayashi et al., filed Dec. 27, 2011.

(Continued)

*Primary Examiner* — Matthew Luu
*Assistant Examiner* — Alexander D Shenderov
(74) *Attorney, Agent, or Firm* — Scully, Scott, Murphy & Presser, P.C.

(57) ABSTRACT

An ink cartridge includes an ink bag that is configured to store ink inside, a spout that is provided on the ink bag and that includes a hollow portion that leads from a first opening to a second opening, and a case that houses the ink bag, an end portion of the case on a side of the second opening including at least a first corner portion and a second corner portion, a width in a first direction being smaller than a width in a second direction in the case, an axial line of the spout being, in the second direction, located closer to one end portion of the case on a side having the first corner portion, and at least one of the first corner portion and the second corner portion forming one of an obtuse angle and a curved surface.

17 Claims, 15 Drawing Sheets

U.S. PATENT DOCUMENTS

| | | | | |
|---|---|---|---|---|
| 7,806,523 | B2 | 10/2010 | Seino et al. | |
| 7,926,925 | B2 | 4/2011 | Ikezaki | |
| 7,954,931 | B2 | 6/2011 | Shimizu et al. | |
| 8,136,932 | B2 | 3/2012 | Nozawa et al. | |
| 8,210,669 | B2 | 7/2012 | Komaki | |
| 8,322,835 | B2 | 12/2012 | Aoki et al. | |
| 2003/0035032 | A1 | 2/2003 | Trafton et al. | |
| 2003/0038867 | A1 | 2/2003 | Yamamoto et al. | |
| 2003/0156175 | A1* | 8/2003 | Blease et al. | 347/97 |
| 2004/0218021 | A1* | 11/2004 | Ishizawa et al. | 347/85 |
| 2005/0057625 | A1 | 3/2005 | Ishizawa et al. | |
| 2005/0179751 | A1 | 8/2005 | Seino et al. | |
| 2006/0197813 | A1 | 9/2006 | Ikezaki | |
| 2008/0070008 | A1 | 3/2008 | Namba et al. | |
| 2008/0151020 | A1 | 6/2008 | Kimura et al. | |
| 2008/0252702 | A1 | 10/2008 | Aoki et al. | |
| 2008/0284810 | A1 | 11/2008 | Shimizu et al. | |
| 2009/0027462 | A1 | 1/2009 | Berg | |
| 2009/0027463 | A1 | 1/2009 | Berg | |
| 2009/0284573 | A1 | 11/2009 | Kambe | |
| 2009/0289971 | A1 | 11/2009 | Gilson et al. | |
| 2009/0303299 | A1 | 12/2009 | Gilson et al. | |
| 2011/0134197 | A1 | 6/2011 | Ishizawa et al. | |
| 2011/0199443 | A1 | 8/2011 | Osawa et al. | |
| 2011/0285797 | A1 | 11/2011 | Ogura et al. | |
| 2012/0249698 | A1 | 10/2012 | Ishizawa et al. | |

OTHER PUBLICATIONS

Related U.S. Appl. No. 13/337,664, to Mizuno et al., filed Dec. 27, 2011.

Related U.S. Appl. No. 13/337,679, to Mizuno et al., filed Dec. 27, 2011.

Office Action dated Jan. 11, 2013 from related U.S. Appl. No. 13/337,643.

Office Action dated Dec. 6, 2012 from related U.S. Appl. No. 13/337,664.

Office Action dated Dec. 21, 2012 from related U.S. Appl. No. 13/337,679.

* cited by examiner

INK CARTRIDGE

CROSS-REFERENCE TO RELATED APPLICATION

This application claims priority to Japanese Patent Application Nos. 2010-293353, 2010-293360, 2010-293364, and 2010-293367, respectively filed Dec. 28, 2010, the content of which is hereby incorporated herein by reference.

BACKGROUND

The present disclosure relates to an ink cartridge including an ink bag that stores ink and a case that houses the ink bag.

Generally, an inkjet printer (hereinafter referred to as a printer) is configured such that an ink cartridge for supplying ink to a print head can be attached to and detached from the printer. An ink cartridge that includes an ink bag, a spout, and a case is known as a general ink cartridge. In this type of ink cartridge, the ink bag may have flexibility and may store ink therein. The spout may be provided to be connected to the ink bag, and may be used to draw out the ink. The case may have a rectangular parallelepiped shape and may house the ink bag.

SUMMARY

The ink bag of the above-described known ink cartridge may have flexibility. Therefore, when the remaining amount of ink becomes small during printing, inner surfaces of the ink bag may come into contact with each other and the ink may be divided. Specifically, part of the ink may not reach the spout and may remain in an ink storage pack.

Various embodiments of the broad principles derived herein provide an ink cartridge that is capable of collecting remaining ink toward a spout even when a remaining ink amount is small.

Embodiments provide an ink cartridge that includes an ink bag that at least includes two layers of flexible sheets disposed to face each other, that is formed in a bag shape, and that is configured to store ink inside, and a spout that is provided on the ink bag and that includes a hollow portion that leads from a first opening to a second opening. The first opening is communicatively connected with the ink bag. The second opening is provided in a leading end portion of the spout and is open to an outside of the ink bag. The ink cartridge also includes a case that houses the ink bag and whose longitudinal direction is an axial direction of the spout that is provided on the ink bag that is housed. An end portion of the case on a side of the second opening includes at least a first corner portion and a second corner portion. The first corner portion is a corner portion that, in the axial direction of the spout, is located on a side of the first opening with respect to the leading end portion of the spout. The second corner portion is a corner portion that, in the axial direction of the spout, is located on a side opposite to the first opening with respect to the leading end portion of the spout. A width in a first direction is smaller than a width in a second direction in the case. The first direction is a direction that is orthogonal to an extending direction of a line connecting the first corner portion and the second corner portion and to the axial direction. The second direction is a direction that is orthogonal to the first direction and to the axial direction. An axial line of the spout is, in the second direction, located closer to one end portion of the case on a side having the first corner portion. The leading end portion of the spout is located inside of the case with respect to the line connecting the first corner portion and the second corner portion. At least one of the first corner portion and the second corner portion forms one of an obtuse angle and a curved surface.

BRIEF DESCRIPTION OF THE DRAWINGS

Embodiments will be described below in detail with reference to the accompanying drawings in which.

DETAILED DESCRIPTION

Figure 1:
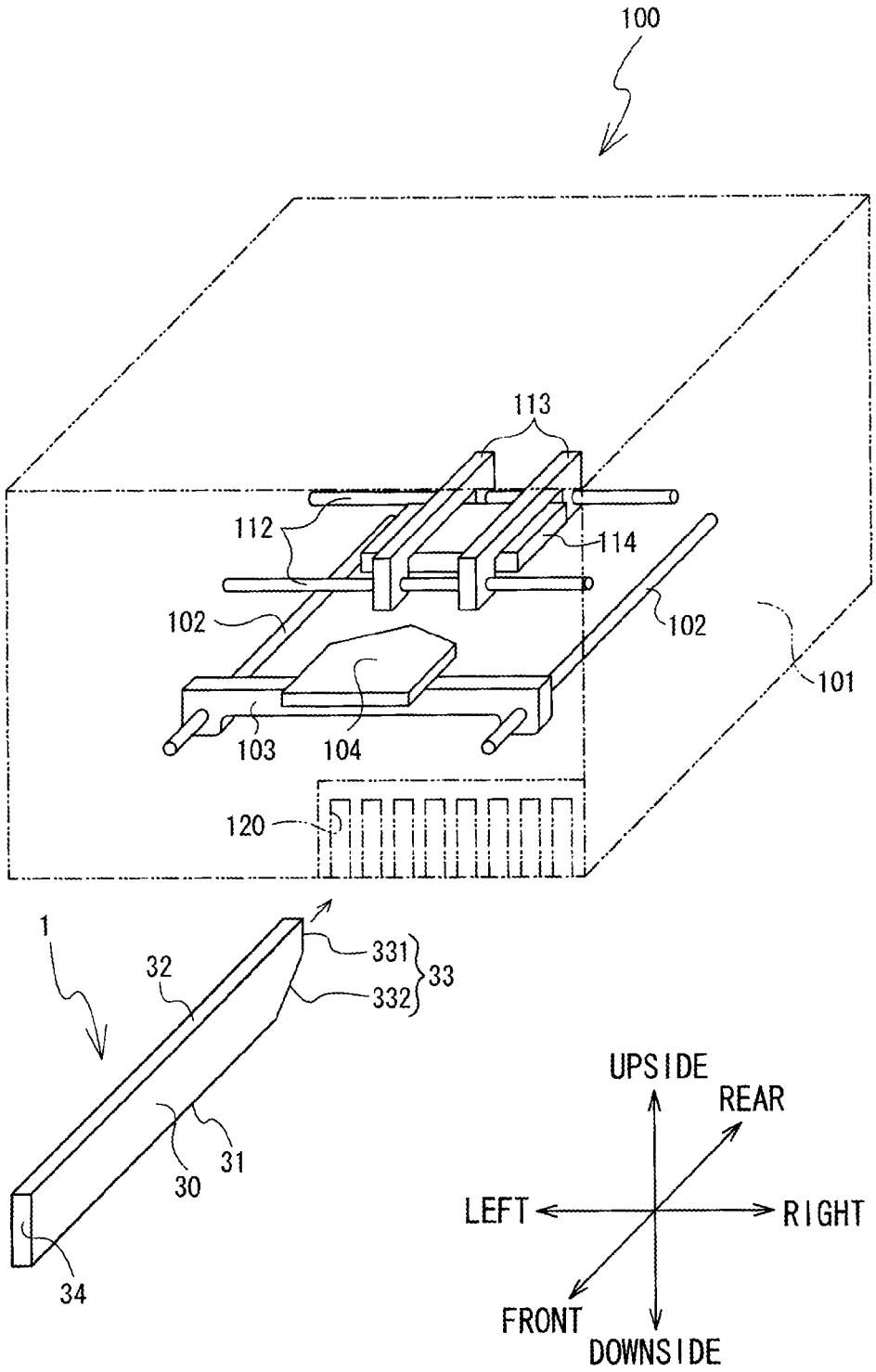
FIG. 1 is a schematic view showing a schematic configuration of an inkjet printer.

Hereinafter, an embodiment of the present disclosure will be explained with reference to the appended drawings.

In the present embodiment, an ink cartridge 1 that is used for an inkjet printer 100 will be explained. The inkjet printer 100 may perform printing on a fabric such as a t-shirt. First, the inkjet printer 100 will be explained with reference to FIG. 1. The inkjet printer 100 is a known printer that can perform printing on a fabric, which is a printing medium, by a print head 114 using ink supplied from the ink cartridge 1. Therefore, the configuration of the inkjet printer 100 will be briefly explained. An up-down direction, a right-left direction and a lower left direction in FIG. 1 respectively correspond to an up-down direction, a right-left direction and a front side of the inkjet printer 100, and also an up-down direction, a right-left direction and a front side of the ink cartridge 1.

The inkjet printer 100 includes a housing 101 that has a rectangular box shape. A pair of guide rails 102 that extend in a front-rear direction are provided in a substantially central lower portion in the right-left direction inside the housing 101. A platen support 103 is supported by the guide rails 102 such that the platen support 103 can be moved in the front-rear direction along the guide rails 102. A platen 104 is fixed to a substantially center position in the right-left direction of an upper surface of the platen support 103. The platen 104 is replaceable. The platen 104 is a plate having a generally pentagonal shape in a plan view. A fabric, such as a t-shirt, may be placed on the upper surface of the platen 104. Although not shown in detail in the drawings, the platen support 103, to which the platen 104 is fixed, may be moved by a platen drive mechanism in the front-rear direction along the guide rails 102. The platen drive mechanism includes a platen drive motor and a belt transmission mechanism.

A pair of guide rails 112 that extend in the right-left direction are provided above the platen 104 in a substantially center position in the front-rear direction of the housing 101. A carriage 113 is supported by the guide rails 112 such that the carriage 113 can be moved in the right-left direction along the guide rails 112. The print head 114 is fixed to a lower portion of the carriage 113. Although not shown in detail in the drawings, the carriage 113 provided with the print head 114 may be moved by a carriage drive mechanism in the right-left direction along the guide rails 112. The carriage drive mechanism includes a carriage drive motor and a belt transmission mechanism. Ink may be supplied to the print head 114 via a tube 142 (refer to FIG. 7) from the ink cartridge 1 that is set in a cartridge mounting portion (not shown in the drawings). The cartridge mounting portion is provided inside the housing 101. A plurality of fine nozzles are provided on a bottom surface of the print head 114. Droplets of the ink may be discharged downward from the nozzles by driving of piezoelectric elements, and thus printing may be performed on the fabric placed on the platen 104.

Eight of the ink cartridges 1 can be set in the cartridge mounting portion provided inside the housing 101. Eight cartridge insertion ports 120 are provided in a lower right portion of a front surface of the housing 101. Each of the cartridge insertion ports 120 is an opening to insert and remove the ink cartridge 1 into and from an ink storage portion. The inkjet printer 100 of the present embodiment may use the four ink cartridges 1 for white ink, and the ink cartridges 1 that respectively store inks of four colors of cyan, magenta, yellow, and black. A method for supplying ink from the ink cartridge 1 to the inkjet printer 100 will be described below.

The structure of the ink cartridge 1 of the present embodiment will be explained with reference to FIGS. 1 to 5. As shown in FIGS. 1 to 4, the ink cartridge 1 includes a case 2 and an ink pack 7. The ink pack 7 is housed in the case 2. Hereinafter, detailed structures of the case 2 and the ink pack 7 will be explained in order. The ink cartridges 1 for five colors, i.e., white, cyan, magenta, yellow, and black, are different only in the color of liquid ink stored in the ink pack 7, and the structures of the case 2 and the ink pack 7 are the same for all the ink cartridges 1.

Figure 2:
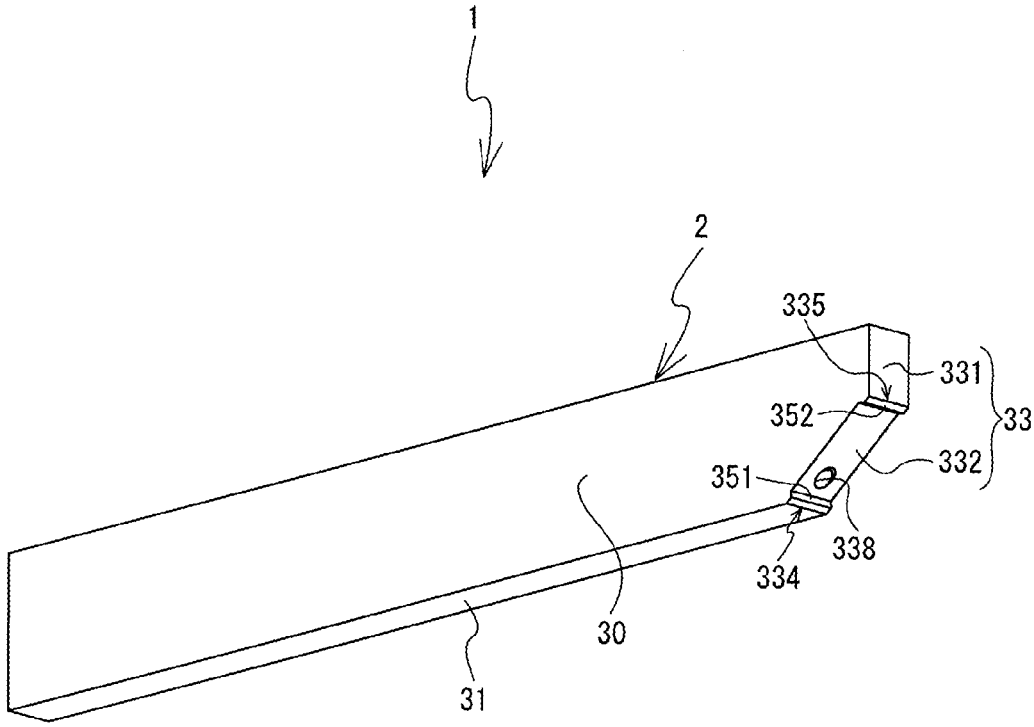
FIG. 2 is a perspective view of an ink cartridge as viewed from the rear right.

As shown in FIG. 2, the case 2 has a thin generally rectangular box shape as a whole. However, the case 2 is formed such that a lower portion on a rear side including a corner portion is cut out obliquely upward toward the rear. A length in the front-rear direction, a length in the up-down direction and a length in the right-left direction of the case 2 are longer in that order.

Figure 3:
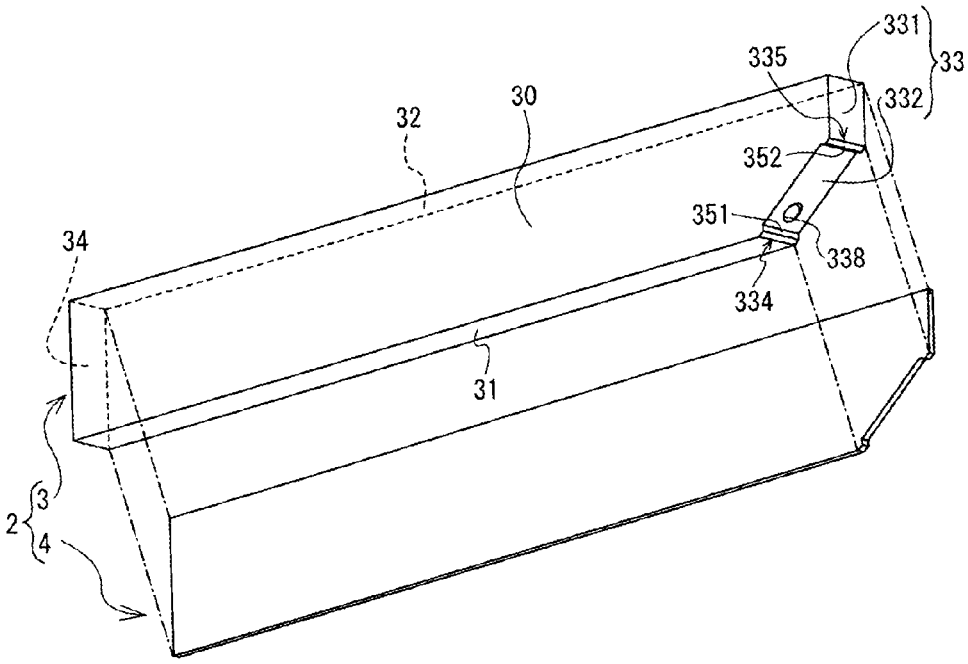
FIG. 3 is an exploded perspective view of a case.

As shown in FIG. 3, the case 2 includes a body portion 3 and a lid portion 4. The body portion 3 includes a right wall 30, a bottom wall 31, an upper wall 32, a rear wall 33, and a front wall 34 that each have a thin plate shape and respectively form a right side surface, a bottom surface, an upper surface, a rear surface and a front surface of the case 2. When the ink cartridge 1 is seen in a side view, namely, when the ink cartridge 1 is seen from a direction that is orthogonal to a maximum area portion (the largest surface among the surfaces shown in FIG. 3) of the right wall 30, the right wall 30 has a generally pentagonal shape. In a side view, the right wall 30 has such a shape that, among four corner portions that form right angles of a rectangle that is longer in the front-rear direction, a corner portion including a corner on the lower rear side is obliquely cut out. Specifically, in a side view, the right wall 30 has two long sides extending in the front-rear direction and facing in parallel to each other, two short sides extending in the up-down direction and facing in parallel to each other, and an oblique side that connects a shorter one of the two long sides and a shorter one of the two short sides.

Figure 5:
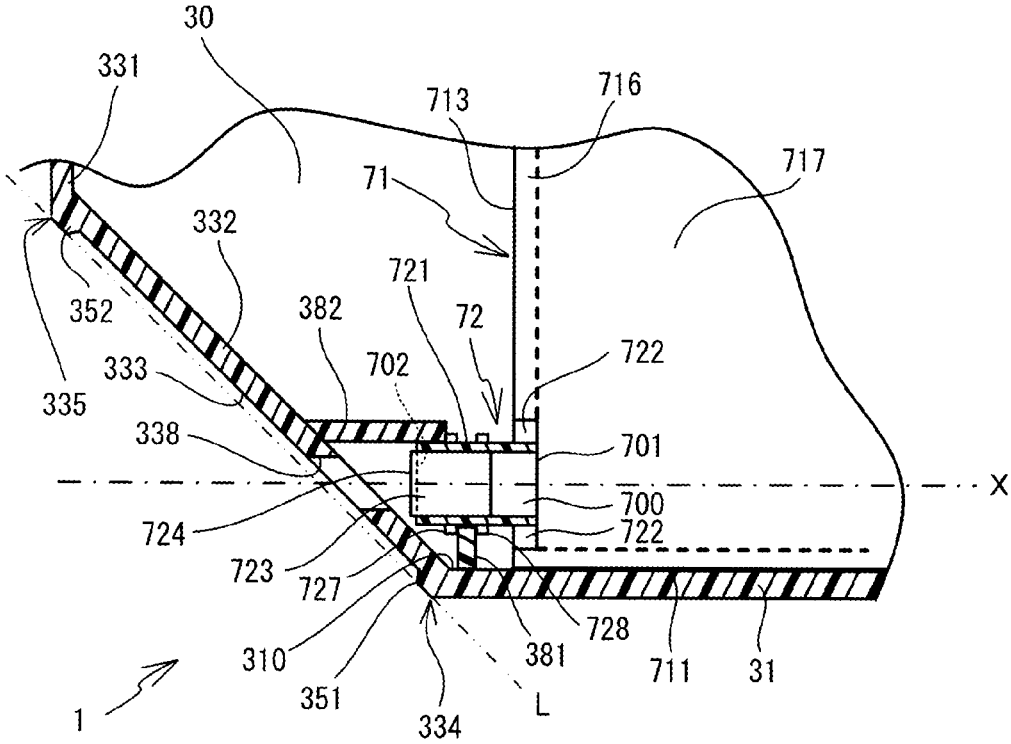
FIG. 5 is an enlarged vertical cross-sectional view of a spout surrounding portion of the ink cartridge.

The oblique side is not exactly a straight line. Both end portions of the oblique side, which connects the shorter one of the short sides and the shorter one of the long sides, are formed as protruding portions. One of the protruding portions protrudes in a stepped manner, slightly in an obliquely upward direction of the ink cartridge 1. The other of the protruding portions protrudes in a stepped manner, slightly in an obliquely downward direction of the ink cartridge 1. Specifically, as shown in FIG. 5, the lower end of the shorter one of the short sides (the side connected to a rear surface portion 331 that will be described below) that extends in the up-down direction is bent obliquely downward (in a lower right direction in FIG. 5) on the front side while forming an obtuse angle (a portion corresponding to a stepped portion 352 that will be described below). The rear end (the left end in FIG. 5) of the shorter one of the long sides (the side connected to the bottom wall 31 that will be described below) that extends in the front-rear direction (in a right-left direction in FIG. 5) is bent obliquely upward (in an upper left direction in FIG. 5) on the rear side while forming an obtuse angle (a portion corresponding to a stepped portion 351 that will be described below).

The bottom wall 31, the upper wall 32, the rear wall 33 and the front wall 34 extend substantially perpendicular to the right wall 30 in the same direction and to the same length. The bottom wall 31 connects to a lower end portion of the right wall 30, namely, the shorter one of the pair of long sides. The upper wall 32 connects to an upper end portion of the right wall 30, namely, a longer one of the pair of long sides. The rear wall 33 includes the rear surface portion 331 and an inclined surface portion 332. The rear surface portion 331 connects to a rear end portion of the right wall 30, namely, the shorter one of the pair of short sides. The inclined surface portion 332 is provided along the oblique side that includes the above-described protruding portions of the right wall 30. The inclined surface portion 332 connects the bottom wall 31 and the rear surface portion 331. Therefore, the inclined surface portion 332 has the stepped portions 351 and 352 at both end portions that connect to the bottom wall 31 and the rear surface portion 331. Therefore, a portion between the stepped portions 351 and 352 of the inclined surface portion 332 is located slightly toward the inside of the case 2 with respect to a line that connects the rear end (a first corner portion 334 that will be described below) of the bottom wall 31 and the lower end (a second corner portion 335 that will be described below) of the rear surface portion 331. The inclined surface portion 332 is provided with a penetration portion 338 in the vicinity of the stepped portion 351 where the inclined surface portion 332 connects to the bottom wall 31. The penetration portion 338 is an opening that penetrates the inclined surface portion 332. The front wall 34 connects to a front end portion of the right wall 30, namely, a longer one of the short sides. The front wall 34 connects the bottom wall 31 and the upper wall 32.

Figure 4:
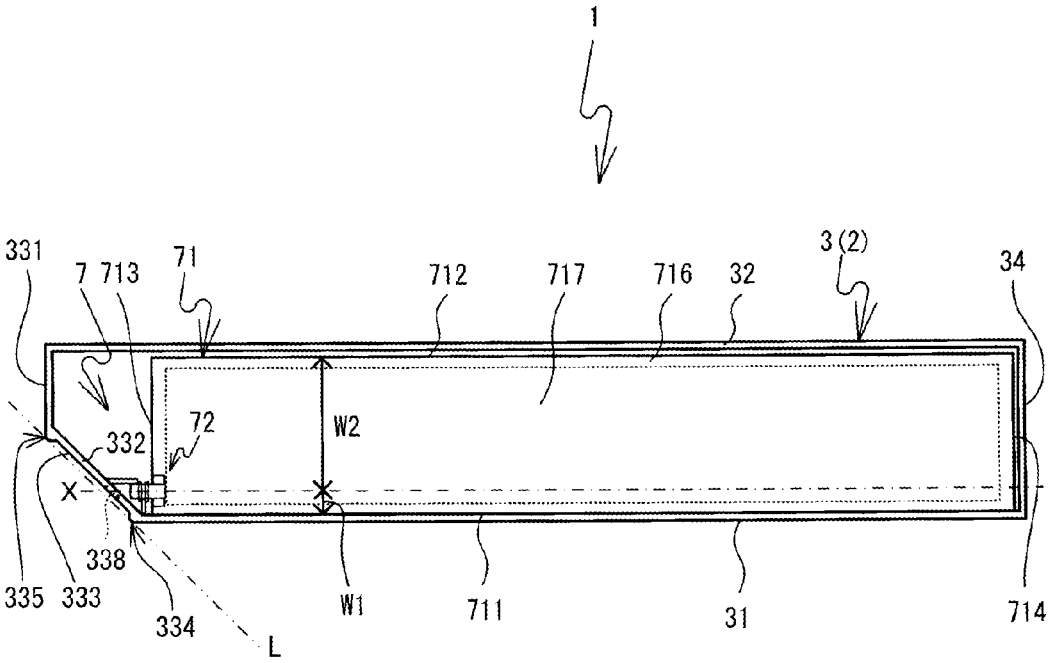
FIG. 4 is an explanatory view showing the ink cartridge in a state in which a lid portion is removed, as viewed from a left side surface.

As shown in FIG. 4, a corner portion at which the upper wall 32 and the rear surface portion 331 are connected, a corner portion at which the upper wall 32 and the front wall 34 are connected, and a corner portion at which the bottom wall 31 and the front wall 34 are connected each form a right angle. On the other hand, a corner portion at which the inclined surface portion 332 and the bottom wall 31 are connected, and a corner portion at which the inclined surface portion 332 and the rear surface portion 331 are connected each form an obtuse angle. Hereinafter, the bottom wall 31, the upper wall 32, the rear wall 33, and the front wall 34 are referred to as the peripheral walls 31 to 34 when collectively referred to.

As shown in FIG. 3, the lid portion 4 faces the right wall 30 and forms a left side surface of the case 2. The lid portion 4 is a thin plate member and has a shape corresponding to the right wall 30 of the body portion 3. More specifically, when the ink cartridge 1 is seen in a side view, namely, when the ink cartridge 1 is seen from a direction that is orthogonal to a maximum area portion (the largest surface among the surfaces shown in FIG. 3) of the lid portion 4, the lid portion 4 has a generally pentagonal shape. In a side view, the lid portion 4 has such a shape that, among four corners forming right angles of a rectangle that is longer in the front-rear direction, a corner portion including a corner on the lower rear side is obliquely cut out. Similarly to the right wall 30, both end portions of an oblique side respectively protrude slightly in an obliquely downward direction and an obliquely upward direction of the ink cartridge 1. The lid portion 4 is joined to the body portion 3 to form the case 2. A method for joining the lid portion 4 to the body portion 3 is not particularly limited. Although not shown in the drawings, for example, the body portion 3 and the lid portion 4 may be provided with an engagement hole and an engagement pin, respectively. The lid portion 4 may be joined to the body portion 3 by inserting the engagement pin into the engagement hole. The lid portion 4 may be joined to the body portion 3 using an engagement hook and an engagement hole, instead of using the engagement pin. The body portion 3 and the lid portion 4 may be fixed by welding.

As shown in FIG. 4, the ink pack 7 is housed inside the case 2, in a space that is surrounded by the peripheral walls 31 to 34. The ink pack 7 includes an ink bag 71 and a spout 72, which is provided on the ink bag 71. The ink bag 71 of the present embodiment is a bag-shaped container that is formed in the following manner. Two rectangular-shaped resin sheets are overlapped with each other such that inner surfaces of the sheets face each other, and a surrounding portion 716 along four sides is thermally welded (heat sealed). The resin sheets have flexibility. Ink may be stored inside an ink storage portion 717 that is a space surrounded by the surrounding portion 716. The ink storage portion 717 has a generally rectangular shape when seen from a direction that is substantially orthogonal to a sheet surface, namely, a maximum area portion (the largest surface among the surfaces shown in FIG. 4) of the sheet surface. The ink storage portion 717 may extend along inner surfaces of the case 2.

It is sufficient if the ink bag 71 includes two layers of flexible sheets that are disposed to face each other and the ink bag 71 is a bag-shaped container in which a space is formed that can store ink between the sheets. Therefore, for example, the ink bag 71 may be formed such that one rectangular sheet is folded in half to form two layers, and the two layers are joined along three sides other than a folded portion. Two sheets that face each other may be joined along three sides of the two sheets and the remaining one side of each of the two sheets may be joined to another sheet, thus forming the ink bag 71 having a bottom portion. The ink bag 71 may be formed such that four sides of two sheets that face each other are respectively joined to other sheets serving as gussets. A method for joining the sheets is not limited to welding and another method such as adhesive bonding, for example, may be used.

As shown in FIGS. 4 and 5, the spout 72 includes a cylindrical-shaped body portion 721 and connection portions 722. The connection portions 722 are two blade-shaped members that protrude in directions opposite to each other from an outer peripheral surface of the body portion 721, and are provided on one end side of the body portion 721. The spout 72 is provided on the ink bag 71 such that an axial line X of the body portion 721 (more precisely, a hollow portion 700 that will be described below) is substantially in parallel with a longitudinal direction of the ink bag 71. The axial line X is located closer to one end portion of the ink bag 71 in a direction (a shorter direction of the ink bag 71) that is orthogonal to the axial line X. In the present embodiment, the spout 72 is provided in the vicinity of one of four corner portions of the ink bag 71. Hereinafter, of two end portions of the ink bag 71 that are located in the direction orthogonal to the axial line X direction, the end portion that is closer to the axial line X is referred to as a first end portion 711 and the end portion that is farther from the axial line X is referred to as a second end portion 712. Of two end portions of the ink bag 71 that are located in the axial line X direction (the longitudinal direction of the ink bag 71), the end portion that is provided with the spout 72 is referred to as a third end portion 713 and the other end portion is referred to as a fourth end portion 714.

In the present embodiment, the spout 72 is fixed to the ink bag 71 such that one end portion of the body portion 721 that includes the connection portions 722 is inserted between the two sheets that form the ink bag 71, and the one end portion is welded integrally with the surrounding portion 716. The other end portion of the body portion 721 that is not welded with the surrounding portion 716 protrudes from the third end portion 713 of the ink bag 71 to the outside of the ink bag 71.

As shown in FIG. 5, the body portion 721 includes two flanges 727 and 728 that are provided along the outer periphery of the body portion 721. Further, the body portion 721 includes the hollow portion 700 inside the body portion 721. The hollow portion 700 leads from a first opening 701 to a second opening 702. The first opening 701 is communicatively connected to the ink storage portion 717 of the ink bag 71. The second opening 702 opens to the outside of the ink bag 71. A cylindrical rubber plug 723 is inserted into an end portion on the second opening 702 side of the hollow portion 700. Therefore, the second opening 702 is closed by the rubber plug 723. In this manner, the ink may be stored in the ink storage portion 717 in a sealed state. It is sufficient if the spout 72 is provided on the ink bag 71 such that the ink storage portion 717 communicates with the outside through the hollow portion 700, and a method for fixing the spout 72 is not limited to welding. Therefore, for example, the spout 72 may be formed integrally with the ink bag 71.

An arrangement relationship between the case 2 and the ink pack 7 will be explained in detail with reference to FIGS. 4 and 5. As shown in FIG. 4, the ink pack 7 is housed in the case 2 such that the axial line X of the spout 72 substantially match the longitudinal direction (the front-rear direction) of the case 2. The ink pack 7 is housed in the case 2 such that the two layers of sheets that form the ink bag 71 extend substantially in parallel with a virtual plane that includes the axial line X of the spout 72 and forms a right angle with an outer surface 333 of the inclined surface portion 332. Therefore, in the present embodiment, outer surfaces of the two layers of sheets extend respectively facing inner surfaces of the right wall 30 and the lid portion 4. The outer surface of one of the two layers of sheets that form the ink storage portion 717 may be adhered to the inner surface of one of the right wall 30 and the lid portion 4.

The sheets that form the ink bag 71 have flexibility. Therefore, when the amount of the remaining ink stored in the ink storage portion 717 is large, the two layers of sheets may curve in directions in which the two layers of sheets are separated from each other. When the remaining amount of the ink is small, the distance between the two layers of sheets may reduce and the two layers of sheets may deflect in directions in which the two layers of sheets come into contact with each other. In summary, because the sheets are not fixed flat surfaces, the sheets are not exactly in parallel with the above-described virtual plane. Therefore, the phrase "substantially in parallel" used in the relationship with the above-described virtual plane includes not only an accurate parallel relationship between flat surfaces, but also an almost parallel state in which deflection of the sheets is allowed.

Further, for example, when the body portion 3 of the case 2, namely, the right wall 30 and the peripheral walls 31 to 34 are integrally formed of resin, generally, a draft angle is provided in order to facilitate release from a cavity of a die. In this case, the right wall 30 and each of the peripheral walls 31 to 34 form an obtuse angle that is wider than a right angle by 2 to 4 degrees. Therefore, as described above, when the outer surface of the sheet of the ink bag 71 is adhered to the inner surface of the right wall 30, the above-described virtual plane and the sheet are not exactly in parallel with each other. However, in a similar manner to the above-described deflection allowance, even when there is an angle difference corresponding to the draft angle, it can be assumed that the above-described virtual plane and the sheet are "substantially in parallel" with each other.

As shown in FIG. 5, in the axial line X direction of the spout 72, the ink pack 7 is housed in the case 2 such that a corner portion, at which the lower end of the inclined surface portion 332 (more precisely, the stepped portion 351) of the case 2 connects to the rear end (the left end in FIG. 5) of the bottom wall 31, is located on the first opening 701 side with respect to a leading end portion 724 (a leading end portion of the rubber plug 723) on the second opening 702 side of the spout 72, and such that a corner portion, at which the upper end of the inclined surface portion 332 (more precisely, the stepped portion 352) connects to the lower end of the rear surface portion 331, is located on an opposite side to the first opening 701 with respect to the leading end portion 724. Accordingly, a line L that connects these two corner portions with the shortest distance obliquely intersects the axial line X. Hereinafter, regarding an end portion of the case 2 in the vicinity of the second opening 702 of the spout 72, in the axial line X direction of the spout 72, the corner portion of the case 2 that is located on the first opening 701 side with respect to the leading end portion 724 is referred to as the "first corner portion 334", and the corner portion that is located on the opposite side to the first opening 701 with respect to the leading end portion 724 is referred to as the "second corner portion 335". In the present embodiment, the corner portion at which the inclined surface portion 332 connects to the bottom wall 31 is the first corner portion 334, and the corner portion at which the inclined surface portion 332 connects to the rear surface portion 331 is the second corner portion 335.

At least one of the first corner portion 334 and the second corner portion 335 is an obtuse angle corner portion or a curved surface corner portion. In the present embodiment, both of the first corner portion 334 and the second corner portion 335 are obtuse angle corner portions. Specifically, the corner formed by an outer surface of the inclined surface portion 332 (in the present embodiment, an outer surface of the stepped portion 351) and an outer surface of the bottom wall 31 (a bottom surface of the case 2), and the corner formed by the outer surface of the inclined surface portion 332 (in the present embodiment, an outer surface of the stepped portion 352) and an outer surface of the rear surface portion 331 (a rear surface of the case 2) are both obtuse angles. In the present embodiment, the outer surfaces of the stepped portions 351 and 352 are partially located on the line L.

As shown in FIG. 5, the bottom wall 31 extends from the first corner portion 334 in the axial line X direction of the spout 72. A rear end portion of the bottom wall 31 (a front side portion of the first corner portion 334) that is located below the spout 72 is referred to as a receiving surface portion 310. Although details will be described below, the receiving surface portion 310 functions as a surface portion to receive ink leaking from the spout 72 below the spout 72.

The ink pack 7 is disposed such that the leading end portion 724 of the spout 72 is located toward the inside of the case 2 with respect to the line L. In the present embodiment, the inclined surface portion 332 is provided between the first corner portion 334 and the second corner portion 335. The outer surface 333 of the inclined surface portion 332 is substantially in parallel with the line L, and is located toward the inside of the case 2 with respect to the line L. The leading end portion 724 is located on the inner side with respect to an inner surface of the inclined surface portion 332. An inner surface of a lower end portion of the inclined surface portion 332 bulges upwardly from a connection portion with the bottom wall 31 toward the penetration portion 338. In the axial line X direction, the leading end portion 724 is located with a clearance from the inner surface (the right surface in FIG. 5) of the lower end portion of the inclined surface portion 332. Therefore, ink can move between the inclined surface portion 332 and the leading end portion 724.

Figure 6:
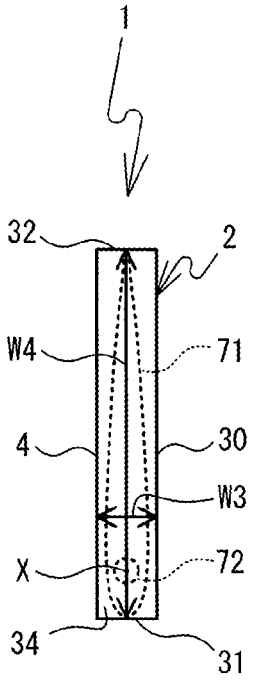
FIG. 6 is a front view of the ink cartridge.

In the present embodiment, a direction (hereinafter referred to as a first direction) that is orthogonal to the extending direction of the line L and the axial line X direction is the right-left direction of the case 2. A direction (hereinafter referred to as a second direction) that is orthogonal to the first direction and the axial line X direction is the up-down direction of the case 2. As shown in FIG. 6, a width (a distance from the left side surface to the right side surface) W3 in the right-left direction of the case 2 is smaller than a width (a distance from the bottom surface to the upper surface, or a height of the right wall 30 and the lid portion 4) W4 in the up-down direction of the case 2.

The ink pack 7 is housed in the case 2 such that, in the second direction, the ink pack 7 is located closer to one end portion of the case 2 on the side including the first corner portion 334. In the present embodiment, the second direction is the up-down direction of the case 2, as described above. Accordingly, in the up-down direction, the one end portion of the case 2 on the side including the first corner portion 334 is an end portion on the bottom wall 31 side. Therefore, as shown in FIG. 4, the axial line X is located closer to the end portion on the bottom wall 31 side in the up-down direction of the case 2. The spout 72 is disposed in the vicinity of the first corner portion 334. Taking the axial line X as a boundary, a width W1 (a distance between the axial line X and the first end portion 711) of the ink bag 71 on the bottom wall 31 side is smaller than a width W2 (a distance between the axial line X and the second end portion 712) of the ink bag 71 on the upper wall 32 side.

As shown in FIG. 5, the penetration portion 338 is provided in the inclined surface portion 332, at a position that faces the second opening 702 of the spout 72. Accordingly, the penetration portion 338 is located on the axial line X of the spout 72. As described above, the second opening 702 is closed by the rubber plug 723. Therefore, actually, the penetration portion 338 faces the rubber plug 723.

Further, the case 2 includes a pair of fixing portions 381 and 382 that are pieces that protrude from the inner surface of the right wall 30 toward the inside of the case 2. The fixing portions 381 and 382 are respectively provided on the bottom wall 31 side and the upper wall 32 side, with the spout 72 interposed between the fixing portions 381 and 382. The fixing portion 381 is formed such that it is also connected to the bottom wall 31 at a position slightly forward (the right side in FIG. 5) of the first corner portion 334. The fixing portion 381 is inserted, from below, between the two flanges 727 and 728 that are provided on the outer periphery of the body portion 721. The fixing portion 382 is formed such that the fixing portion 382 is connected to the inclined surface portion 332. The fixing portion 382 is in contact, from the rear, with a side surface of the flange 727 on the leading end portion 724 side. Thus, the spout 72 can be reliably disposed and fixed in an accurate position by the fixing portions 381 and 382. The case 2 may be provided with only one of the fixing portions 381 and 382, or may not be provided with the fixing portions 381 and 382.

A method for supplying ink from the ink cartridge 1 to the print head 114 of the inkjet printer 100 will be explained with reference to FIGS. 1 and 7. As shown in FIG. 1, when printing is performed, a user may insert the ink cartridge 1 into the cartridge insertion port 120 of the inkjet printer 100. At this time, the user may insert the ink cartridge 1 from the rear wall 33 side, with the bottom wall 31 of the ink cartridge 1 being on the lower side. The rear wall 33 is provided with the penetration portion 338 (refer to FIG. 2) that faces the second opening 702 (the rubber plug 723).

Figure 7:
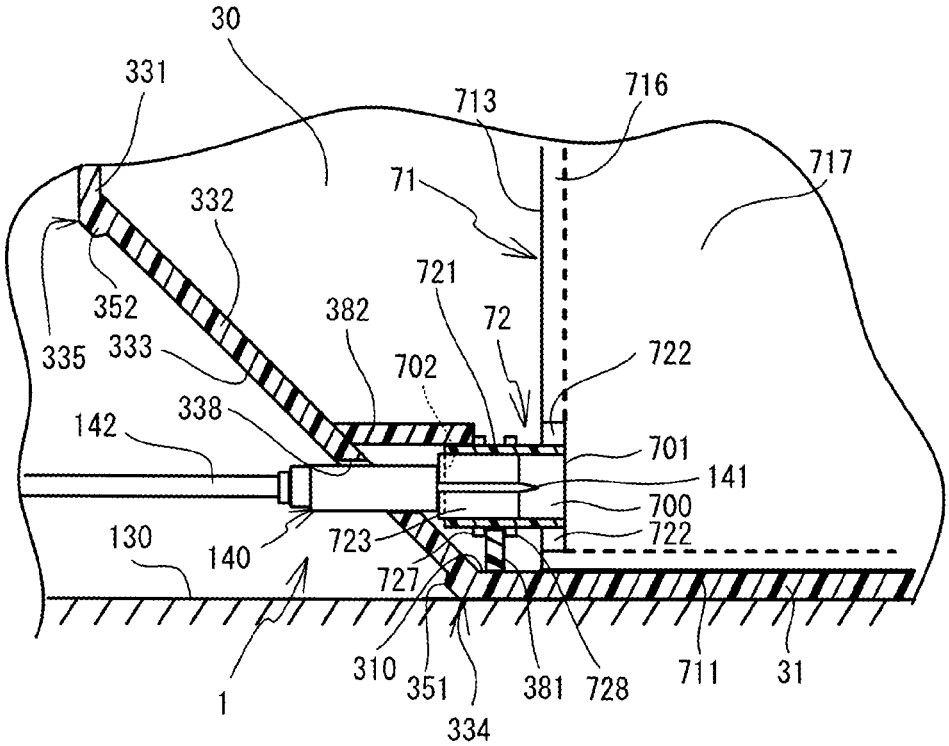
FIG. 7 is an enlarged partial cross-sectional view of the spout surrounding portion of the ink cartridge when ink is supplied.

As shown in FIG. 7, the ink cartridge 1 may be set such that the bottom wall 31 is placed on a placement surface 130 of the cartridge mounting portion. The placement surface 130 is a flat surface that extends in a substantially horizontal direction. Therefore, the ink cartridge 1 may be set in the inkjet printer 100 such that the bottom wall 31 and the axial line X of the spout 72 extend substantially horizontally. A connection portion 140 including a hollow needle 141 is provided inside the cartridge mounting portion, at a position facing the penetration portion 338 (the spout 72) when the ink cartridge 1 is set. A tube 142 is connected to the connection portion 140. The tube 142 may lead the ink drawn out from the ink bag 71 to the print head 114. When the ink cartridge 1 is set in the cartridge mounting portion, the hollow needle 141 of the connection portion 140 pierces a central portion of the rubber plug 723 through the penetration portion 338. The hollow needle 141 may penetrate the rubber plug 723 and a leading end portion of the hollow needle 141 may be disposed inside the hollow portion 700. The leading end portion of the hollow needle 141 is provided with a hole through which ink flows. The ink in the ink storage portion 717 may be supplied to the print head 114 via the first opening 701, the inside of the hollow portion 700, the hollow needle 141, and the tube 142.

When the ink cartridge 1 is initially used, the ink storage portion 717 of the ink bag 71 may be completely filled with ink. Accordingly, the inner surfaces of the two layers of sheets that form the ink bag 71 may be separated from each other, with the ink interposed between the inner surfaces. While printing is performed, the ink may be discharged from the print head 114 little by little in order to form an image on the fabric. When the ink is discharged, a substantially same amount of ink as a discharge amount may be sucked from the ink cartridge 1, and the sucked ink may be supplied to the print head 114. The ink stored in the ink storage portion 717 may gradually reduce as the ink is consumed by printing, and the ink bag 71 may contract. As a result, the inner surfaces of the two layers of flexible sheets may come closer to each other.

When the amount of the remaining ink reduces to a certain extent, the inner surfaces of the sheets may come into contact with each other in various locations in the ink bag 71. As a result, the ink may be divided by portions where the inner surfaces of the sheets come into contact with each other, due to surface tension of the ink, gravitational force, and the like, for example. In this case, a plurality of ink deposits may exist that are isolated in the ink storage portion 717. Further, in a state in which the bottom wall 31 is placed on the substantially horizontal placement surface 130, the two layers of sheets of the ink bag 71 are disposed such that the surfaces of the sheets extend substantially in the up-down direction. Therefore, due to the gravitational force, part of the ink may flow downward along the inner surface of the sheet and may be accumulated along the first end portion 711 (refer to FIG. 4) inside the ink storage portion 717. As the ink reduces, the ink surface may become lower than the hole in the leading end portion of the hollow needle 141. In this case, even when the ink still remains in the ink storage portion 717, it is difficult to suck the remaining ink because a suction force of the print head 114 is weak.

Figure 8:
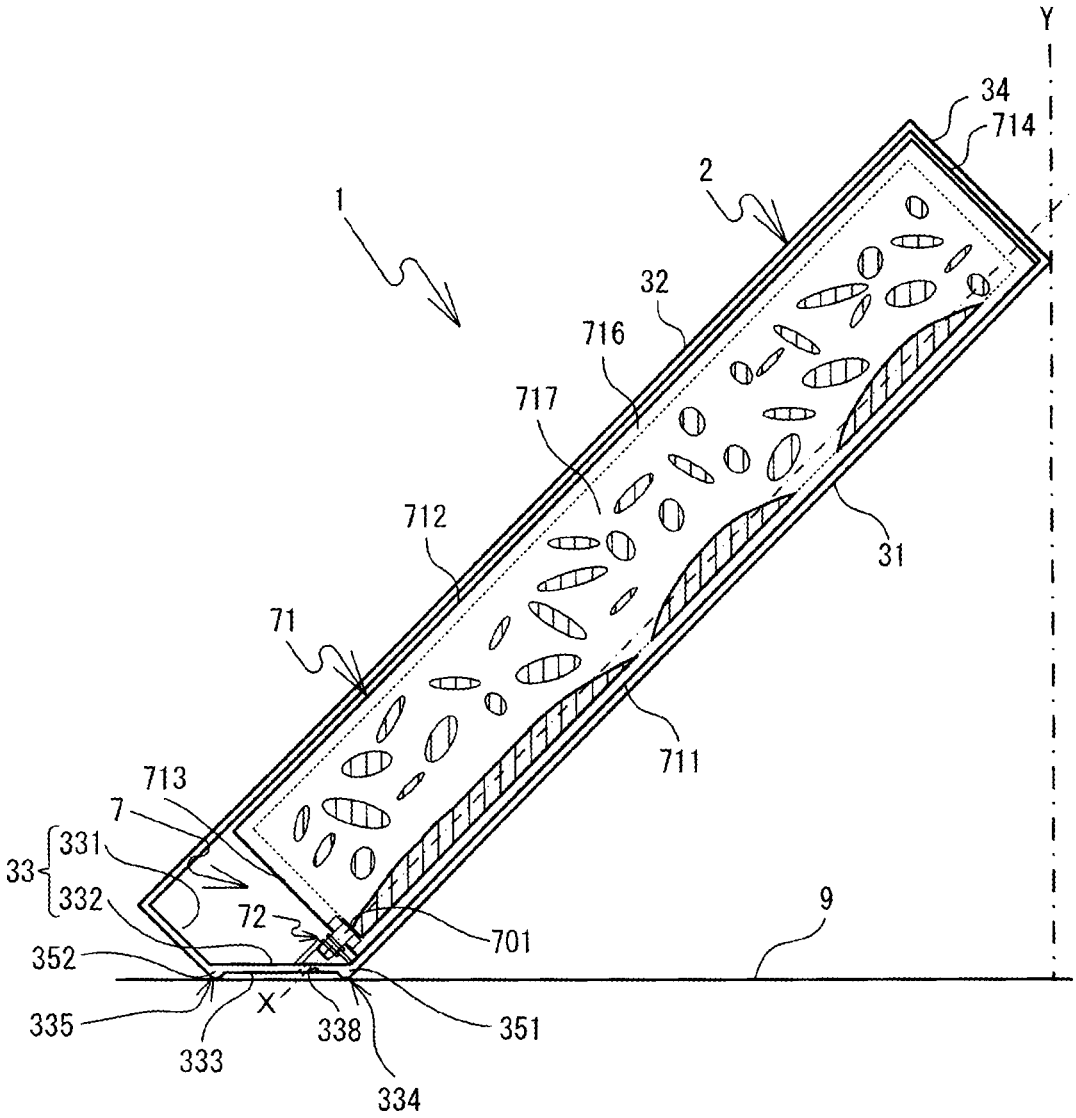
FIG. 8 is an explanatory view showing a process in which the ink is collected by tilting the ink cartridge.

Even when it is difficult to suck the ink in this manner, the ink cartridge 1 of the present embodiment can be removed from the inkjet printer 100, and owing to the above-described structure, the ink remaining in the ink storage portion 717 can be effectively collected toward the spout 72, more specifically, toward the first opening 701. This operational effect will be explained with reference to FIGS. 8 to 10. As shown in FIG. 8, the user may place the ink cartridge 1, in which the remaining ink amount is reduced and part of the ink is accumulated along the first end portion 711, on a support surface 9 that is a substantially horizontal plane, with the first corner portion 334 and the second corner portion 335 of the ink cartridge 1 being on the lower side. At this time, the user may place the ink cartridge 1 such that the first corner portion 334 and the second corner portion 335 come into contact with the support surface 9. Accordingly, the axial line X direction that substantially matches the longitudinal direction of the ink storage portion 717 is closer to upright than when ink is supplied in the inkjet printer 100.

In the present embodiment, the outer surfaces of the stepped portions 351 and 352 of the inclined surface portion 332 are located on the line L (refer to FIG. 5) that connects the first corner portion 334 and the second corner portion 335. Therefore, the outer surfaces of the stepped portions 351 and 352 may come into contact with the support surface 9 and may be supported by the support surface 9. The portion between the stepped portions 351 and 352 of the inclined surface portion 332 may be slightly above and separated from the support surface 9. The support surface 9 may be a flat surface, such as a desk top surface, or may not be a flat surface. The leading end portion 724 on the second opening 702 (refer to FIG. 5) side of the spout 72 is located toward the inside of the case 2 with respect to the line L, and further toward the inside of the case 2 than the outer surface 333 that is positioned on the inner side of the line L (in the present embodiment, the leading end portion 724 is located on the inner side with respect to the inner surface of the inclined surface portion 332). Therefore, when the first corner portion 334 and the second corner portion 335 come into contact with the support surface 9, the spout 72 does not come in contact with the support surface 9.

In the ink cartridge 1, the longitudinal direction (the axial line X of the spout 72) of the case 2 and the ink bag 71 may incline with respect to the horizontal direction. Therefore, the second opening 702 of the spout 72 may be directed obliquely downward. More specifically, the posture of the ink cartridge 1 may be changed from the posture when the ink cartridge 1 is set in the inkjet printer 100 (the posture in which the axial line X of the spout 72 is substantially horizontal) to an inclined posture. The first end portion 711 of the ink bag 71 in the case 2 may incline with respect to the horizontal direction. In a similar manner to when the bottom wall 31 is placed on the substantially horizontal placement surface 130, the two layers of sheets that form the ink storage portion 717 may be disposed such that the surfaces of the sheets extend substantially in the up-down direction. Part of the ink may move in the ink storage portion 717 due to force that is applied when the posture of the ink cartridge 1 is changed. In a state in which the axial line X of the spout 72 is substantially horizontal (refer to FIGS. 4 and 6) before the posture of the ink cartridge 1 is changed, the ink dispersed in the ink storage portion 717 may not move because the inner surfaces of the sheets are in contact with each other. At this time, the direction of the gravitational force applied to the dispersed ink may be substantially perpendicular to the axial line X of the spout 72. On the other hand, when the posture of the ink cartridge 1 is changed as shown in FIG. 8, the direction of the gravitational force applied to the dispersed ink may change to an oblique direction with respect to the axial line X of the spout 72.

Figure 9:
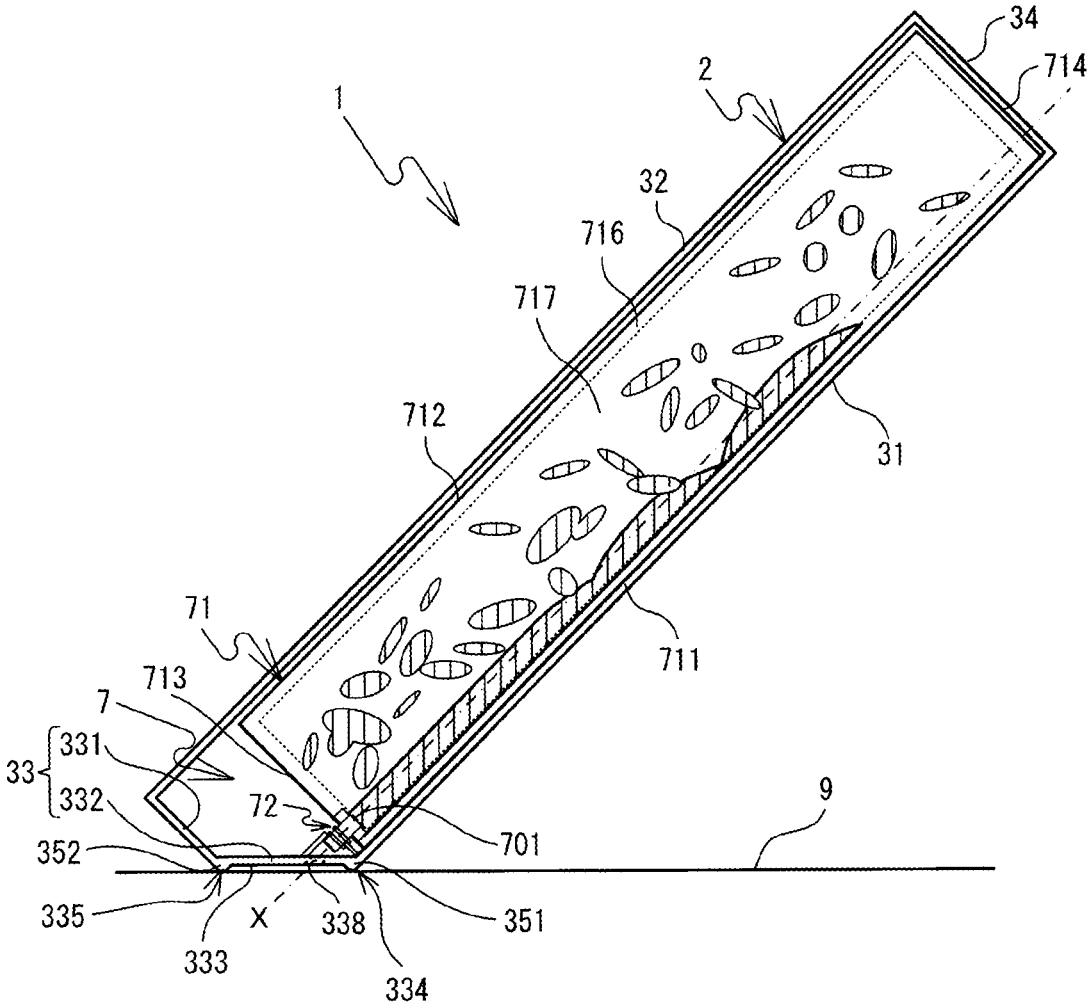
FIG. 9 is another explanatory view showing a process in which the ink is collected by tilting the ink cartridge.

After the posture of the ink cartridge 1 has been changed in this manner, the user may continue to hold the ink cartridge 1 in an inclined state for a while. In this case, as shown in FIG. 9, the ink in the ink storage portion 717 may start to move downward along the inner surface of the sheet due to the gravitational force and the movement of the ink along with the above-described change in posture. As described above, the surfaces of the sheets extend substantially in the up-down direction, and thus the ink can move smoothly downward. The ink accumulated along the first end portion 711 inside the ink storage portion 717 may flow toward the first corner portion 334 along the first end portion 711 because the first end portion 711 is inclined with respect to the horizontal direction. The spout 72 is provided in the vicinity of the first corner portion 334. Some of the isolated plurality of ink deposits may start to move downward due to the gravitational force. A part of the ink deposits may flow and join with another ink deposit in the middle of downward movement to thereby form a larger ink deposit, and the larger ink deposit may move downward. In this manner, the ink may flow toward the spout 72 along the first end portion 711.

The first corner portion 344 forms an obtuse angle. In the case 2, the axial line X of the spout 72 is located closer to the end portion on the bottom wall 31 side having the first corner portion 334. Therefore, when the ink cartridge 1 is inclined such that the first corner portion 334 and the second corner portion 335 are positioned on the lower side and the inclined surface portion 332 is positioned substantially horizontally, the spout 72 may be disposed in a position that is closer to the support surface 9. As a result, the ink may easily collect in the vicinity of the first opening 701 of the spout 72. Further, the axial line X is located closer to one end portion (the first end portion 711) of the ink bag 71 in the direction that is orthogonal to the axial line X. Taking the axial line X as a boundary, the width of the ink bag 71 on the first end portion 711 side is smaller than the width of the ink bag 71 on the opposite side. Therefore, when the ink cartridge 1 is inclined such that the inclined surface portion 332 is substantially horizontal, the ink may easily collect in the vicinity of the first opening 701 of the spout 72.

Figure 10:
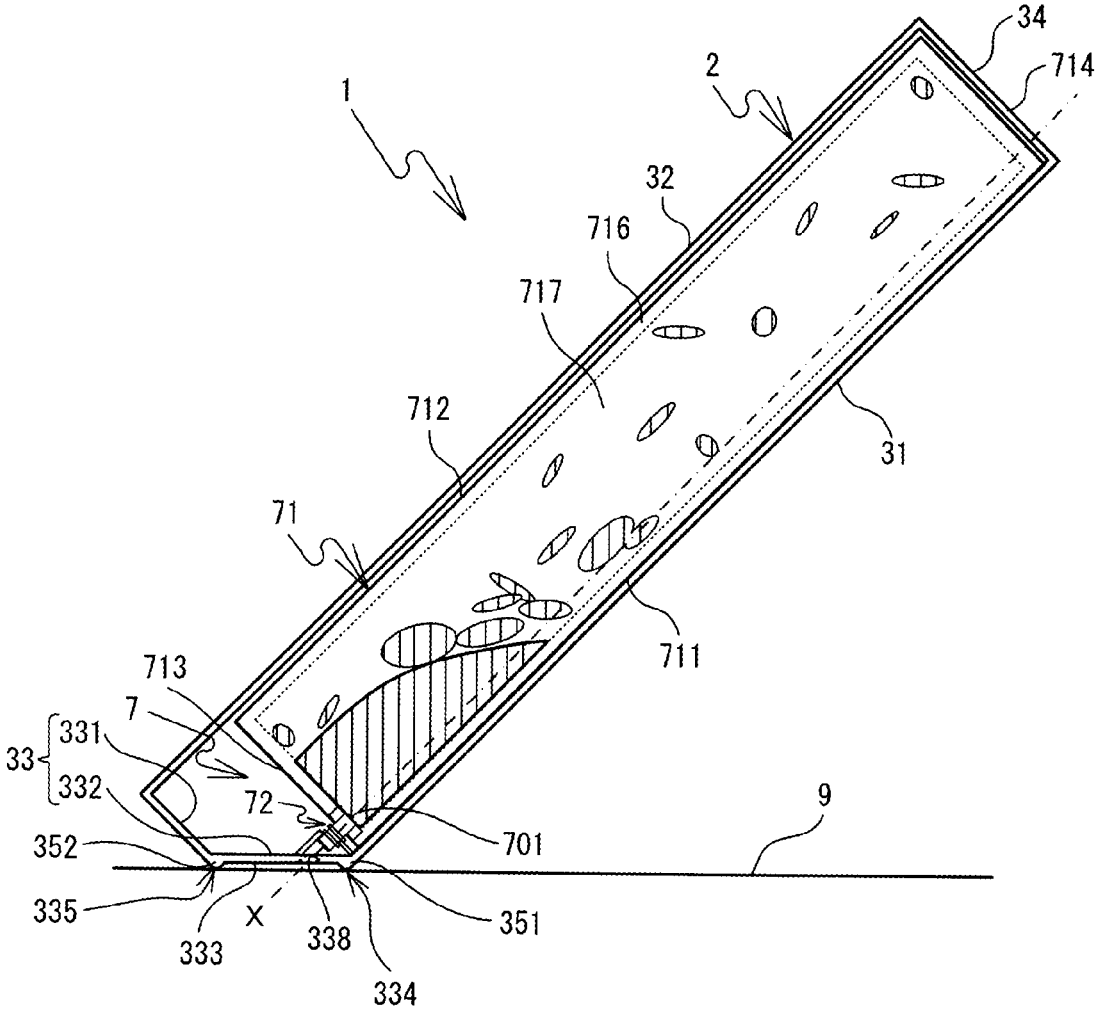
FIG. 10 is yet another explanatory view showing a process in which the ink is collected by tilting the ink cartridge.

Further, when the ink cartridge 1 continues to be inclined, as shown in FIG. 10, most of the ink that remained in the form of ink deposits in various locations inside the ink storage portion 717 may gather in the vicinity of the first opening 701 of the spout 72. In this state, most of the inner surfaces of the sheets may be in contact with each other in the fourth end portion 714 of the ink bag 71 and the vicinity of the fourth end portion 714. In the longitudinal direction of the ink bag 71, the fourth end portion 714 is located on the side opposite to the side where the spout 72 is provided.

In the state in which the ink is collected in the vicinity of the first opening 701 in this manner, the user may set the ink cartridge 1 in the inkjet printer 100 again, with the wall surface 31 being on the lower side, as shown FIG. 7. As shown in FIG. 10, more ink may be collected in the vicinity of the first opening 701 as compared to the state shown in FIG. 8. In addition, in the fourth end portion 714 of the ink bag 71 and the vicinity of the fourth end portion 714, most of the inner surfaces of the two sheets may be in contact with each other. Therefore, even when the bottom wall 31 is placed on the placement surface 130 and the first end portion 711 is positioned substantially horizontally, it is possible to inhibit to some extent the movement of the ink from the vicinity of the first opening 701 toward the fourth end portion 714. As a result, it is possible to maintain a state in which the ink surface is above the hole of the leading end portion of the hollow needle 141 that has pierced the rubber plug 723. Thus, the remaining ink can be supplied to the print head 114.

As explained above, in the ink cartridge 1 of the present embodiment, the longitudinal direction is the axial line X direction of the spout 72 of the ink bag 71. The first corner portion 334 and the second corner portion 335 are provided in the case 2 in which the width W3 in the right-left direction is smaller than the width W4 in the up-down direction. In the axial direction of the spout 72, the first corner portion 334 and the second corner portion 335 are respectively located on the first opening 701 side and the opposite side of the first opening 701 side, with respect to the leading end portion 724 of the second opening 702. In the case 2, the axial line X of the spout 72 is located closer to the end portion on the bottom wall 31 side having the first corner portion 334. The first corner portion 334 and the second corner portion 335 are obtuse angle corner portions.

Therefore, when the amount of the remaining ink becomes small, the user can stably place the ink cartridge 1 in an inclined state with respect to the horizontal direction, using the first corner portion 334 and the second corner portion 335 as described above. When the user holds the ink cartridge 1 in the air, there is a possibility that the ink cartridge 1 will slip from the user's hand for some reason and be dropped. At this time, if the ink cartridge 1 is in a posture in which the spout 72 is located on the upper side, the flow of the ink toward the spout 72 may be inhibited. However, as described above, the ink cartridge 1 is adapted for the inclined surface portion 332 to be placed on the substantially horizontal support surface 9. Therefore, when the inclined surface portion 332 is placed on the support surface 9, the downward flow of the ink due to the gravitational force may be stabilized. As a result, the possibility may be reduced that a force in the completely opposite direction is applied to the ink. It is therefore possible to effectively collect the ink remaining in the ink bag 71 toward the spout 72.

In addition, the ink cartridge 1 can be easily held in an inclined state by placing the ink cartridge 1 such that the first corner portion 334 and the second corner portion 335 come into contact with a surface, such as a desk top surface. Therefore, as compared to a case in which the user grasps the ink cartridge 1 in an inclined state in the air, it is possible to reduce the user's force that is required and to improve user-friendliness. Particularly, in the present embodiment, part of the outer surfaces of the stepped portions 351 and 352 that respectively connect to the first corner portion 334 and the second corner portion 335 is located above the line L that connects the first corner portion 334 and the second corner portion 335. Therefore, it is possible to maintain the inclined state of the ink cartridge 1 more easily. In addition, the first corner portion 334 and the second corner portion 335 are obtuse angle corner portions.

Therefore, when the ink cartridge 1 is placed on a material, such as a carpet, into which the ink cartridge 1 may sink, the first corner portion 334 and the second corner portion 335 are unlikely to become caught up in the material. It is therefore possible to easily change the posture of the ink cartridge 1.

Further, the outer surface of the portion between the stepped portions 351 and 352 of the inclined surface portion 332 is substantially parallel to the line L and is located on the inner side of the line L. Therefore, even when the user places and holds the ink cartridge 1 such that the first corner portion 334 and the second corner portion 335 come into contact with a support surface, such as a desk top surface, the penetration portion 338 provided in the inclined surface portion 332 does not come into contact with the support surface. Therefore, even when ink adheres to the vicinity of the second opening 702, it is possible to reduce a possibility that the ink will adhere to the support surface. In addition, since the leading end portion 724 of the spout 72 is located inwardly from the outer surface 333 of the inclined surface portion 332, it is possible to protect the spout 72 by the inclined surface portion 332. However, it is sufficient if the leading end portion 724 of the spout 72 is located toward the inside of the case 2 with respect to the line L at least.

When the ink cartridge 1 is pulled out from the inkjet printer 100, for example, there is a case in which the ink leaks from the spout 72. When the ink cartridge 1 is disposed such that the bottom wall 31 is directed downward, the ink that has leaked may drop downward along the leading end portion 724 of the rubber plug 723 and may drop down along the lower end of the body portion 721 due to the surface tension of the ink. In the present embodiment, the receiving surface portion 310 is provided that is substantially horizontally disposed below the spout 72. Therefore, the receiving surface portion 310 can receive the ink that has dropped down. Further, a portion extending from the first corner portion 334 of the inclined surface portion 332 to the penetration portion 338 is inclined upward. Therefore, it is possible to reduce a possibility that the ink received by the receiving surface portion 310 moves toward the penetration portion 338 and leaks from the penetration portion 338. Thus, it is possible to reduce a possibility that the inkjet printer 100 and a fingers etc. of the user who handles the ink cartridge 1 become stained with the ink.

In many cases, pigment ink that contains pigment is used as ink for the inkjet printer 100. Therefore, in many cases, the ink bag 71 in the ink cartridge 1 is filled with pigment ink. In a case where the ink cartridge 1 is shaken and the ink in the ink bag 71 is agitated, the ink may be scattered over a wide range in the ink bag 71.

With the ink cartridge 1, even in this type of case, it is possible to collect the remaining ink toward the spout 72 by inclining the ink cartridge 1 with the use of the first corner portion 334 and the second corner portion 335. It is therefore possible to reduce waste of the ink. In a white ink that contains titanium oxide, the titanium oxide is likely to be precipitated. However, with the ink cartridge 1 of the present embodiment, when the ink cartridge 1 is inclined using the first corner portion 334 and the second corner portion 335, the axial direction of the spout 72 becomes oblique with respect to the horizontal direction. Therefore, as compared to a case in which the axial line X is oriented vertically, titanium oxide is less likely to be precipitated in the first opening 701 of the spout 72. It is therefore possible to inhibit a state in which the ink cannot be used for printing as a result that titanium oxide is precipitated on the first opening 701 and an ink composition is divided into two parts, for example.

Emulsion ink that contains emulsion is also used in many cases as ink for the inkjet printer 100. The emulsion ink has high viscosity as compared to an ink that does not contain emulsion. Therefore, even when the ink cartridge 1 is inclined, it is more difficult for the ink to move and it takes time to collect the ink downward. According to the ink cartridge 1 of the present embodiment, it is possible to easily hold the ink cartridge 1 in an inclined state by placing the ink cartridge 1 such that the first corner portion 334 and the second corner portion 335 come into contact with a support surface, such as a desktop surface. This is particularly advantageous as compared to a case in which the user holds an ink cartridge for a long time in the air. In addition, when the emulsion ink also contains titanium oxide, it is possible to effectively collect the emulsion ink while inhibiting precipitation of titanium oxide in the first opening 701 of the spout 72, as described above.

The case 2 is provided with the inclined surface portion 332 that connects the first corner portion 334 and the second corner portion 335. It is therefore possible to alleviate an impact that is received by the spout 72 when the ink cartridge 1 is dropped. Specifically, the first corner portion 334, where the inclined surface portion 332 of the case 2 connects to the bottom wall 31, forms an obtuse angle. The spout 72 is disposed in the vicinity of the first corner portion 334. When an impact is applied to this type of obtuse angle corner portion, stress is less likely to concentrate on the corner portion, as compared to a right angle corner portion. Therefore, as compared to the right angle corner portion, it is possible to reduce a possibility that a strong impact is applied to the corner portion and that the spout 72 located in the vicinity is damaged or the disposed position of the spout 72 is displaced significantly. Further, for example, at the time of shipment, it is assumed that the ink cartridge 1 is packed in a rectangular parallelepiped box having substantially the same size as the ink cartridge 1. In this type of case, a triangular prism-shaped space is formed between the inclined surface portion 332 and the box. As a result, even if the box is dropped, for example, and the ink cartridge 1 receives an impact, this space may serve as a cushion. It is therefore possible to alleviate the impact received by the spout 72.

As shown in FIG. 5, in a state in which the axial line X of the spout 72 of the ink cartridge 1 is substantially horizontal, the upper surface (the inner surface) of the inclined surface portion 332 projects in the leading end direction of the leading end portion 724, beyond the lower side of the leading end portion 724. Therefore, even if the ink drops downward from the leading end portion 724 when the hollow needle 141 is pulled out from the spout 72, the ink may collide with the upper surface of the inclined surface portion 332. The ink may move toward the inner side (the first opening 701 side) of the ink cartridge 1 along the slope of the inclined surface portion 332. Therefore, the vicinity of the ink cartridge 1 may be inhibited from being contaminated with the ink.

Not only when the hollow needle 141 for supplying ink to the inkjet printer 100 is pulled out from the spout 72, the contamination prevention effect can also be expected in another case. For example, also when a hollow needle that is used to initially fill, add, or refill ink to the ink bag 71 is pulled out, ink may drop. Therefore, also in this type of case, a similar effect can be expected. In the state shown in FIG. 5, in a case where the ink adheres to the leading end portion 724 in accordance with insertion and removal of the hollow needle 141, the ink may be located on a lower end portion of the leading end portion 724. In that ink state, if the ink cartridge 1 is inclined as shown in FIG. 9, the upper surface (the inner surface) of the inclined surface portion 332 is located below the lower end portion of the leading end portion 724 in the state shown in FIG. 5. Therefore, even when the ink drops downward from the leading end portion 724, the ink may collide with the upper surface of the inclined surface portion 332. Thus, it is possible to suppress the vicinity of the ink cartridge 1 from being contaminated with the ink.

As shown in FIG. 5, the above-described ink cartridge 1 is an example in which the inclined surface portion 332 having the stepped portions 351 and 352 is provided between the first corner portion 334 and the second corner portion 335, both of which form obtuse angles. However, as long as the first corner portion 334 and the second corner portion 335 are placed so as to come into contact with a substantially horizontal surface and the longitudinal direction of the case 2 can be maintained in an inclined state with respect to the horizontal direction, the shape etc. of the first corner portion 334, the second corner portion 335, and the portion between the first corner portion 334 and the second corner portion 335 can be appropriately changed. Some modified examples will be explained below with reference to FIGS. 11 to 15.

Figure 11:
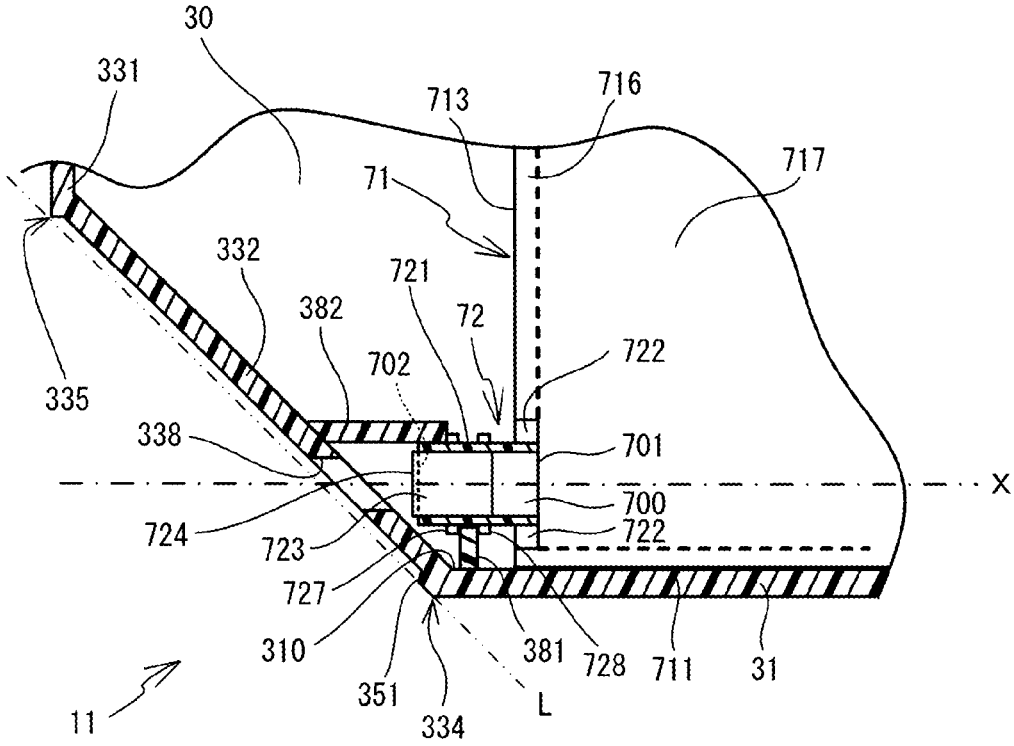
FIG. 11 is an enlarged vertical cross-sectional view of a spout surrounding portion of an ink cartridge according to a first modified example.

An ink cartridge 11 of a first modified example shown in FIG. 11 corresponds to an ink cartridge in which the stepped portion 352 of the ink cartridge 1 shown in FIG. 5 is omitted. In the ink cartridge 11, the upper end of the inclined surface portion 332 is connected to the lower end of the rear surface portion 331 that forms a right angle, namely, the second corner portion 335. Similarly to the ink cartridge 1, the first corner portion 334 is an obtuse angle corner portion. The inclined surface portion 332 is substantially in parallel with the line L that connects the first corner portion 334 and the second corner portion 335, and is located toward the inside of the case 2 with respect to the line L.

Therefore, similarly to the ink cartridge 1, when the amount of remaining ink becomes small, the ink cartridge 11 can be placed such that the first corner portion 334 and the second corner portion 335 come into contact with a support surface. Therefore, the ink cartridge 11 can be held in an inclined state. As a result, it is possible to effectively collect the ink remaining in the ink bag 71 toward the first opening 701 of the spout 72. Of the first corner portion 334 and the second corner portion 335, the first corner portion 334 forms an obtuse angle. Therefore, similarly to the ink cartridge 1, even when the ink cartridge 11 is placed on a material, such as a carpet, into which the ink cartridge 11 may sink, at least the first corner portion 334 is unlikely to become caught up in the material. It is therefore possible to easily change the posture of the ink cartridge 11. In addition to the first modified example, of the first corner portion 334 and the second corner portion 335, only the second corner portion 335 may be formed to have an obtuse angle. The corner portion other than the obtuse angle corner portion is not limited to a right angle corner portion, and may be an obtuse angle corner portion or a curved surface corner portion.

Figure 12:
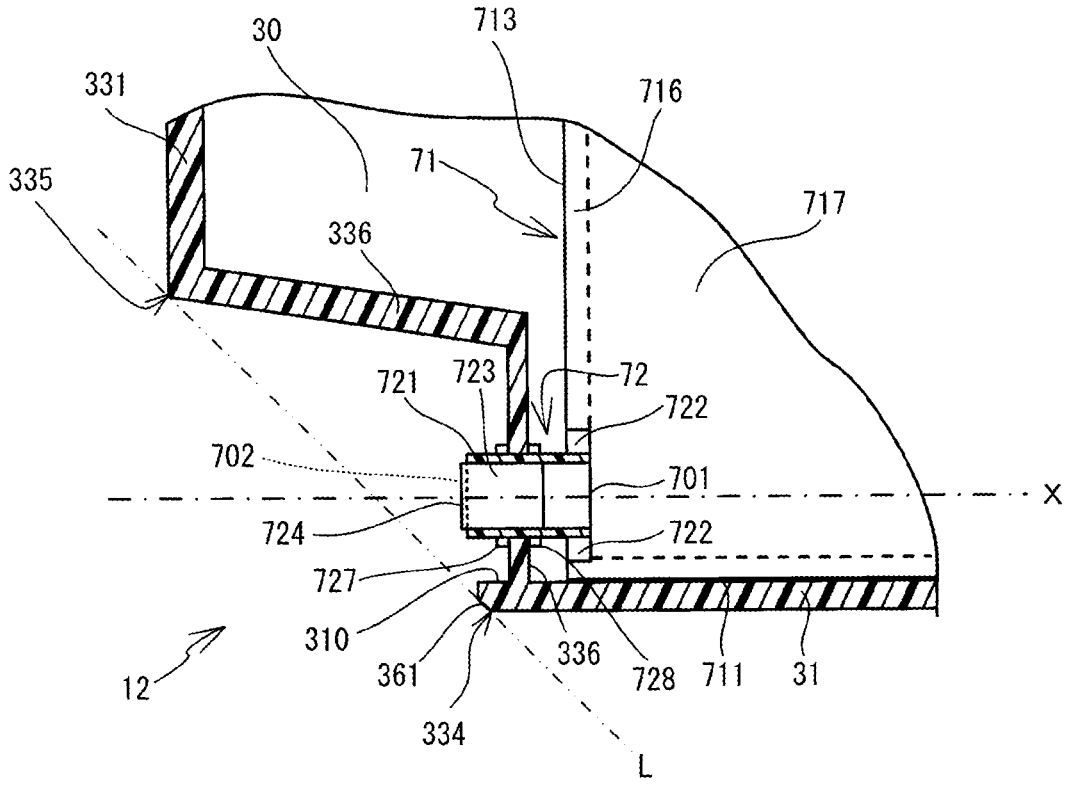
FIG. 12 is an enlarged vertical cross-sectional view of a spout surrounding portion of an ink cartridge according to a second modified example.

An ink cartridge 12 of a second modified example shown in FIG. 12 is an example in which, in place of the inclined surface portion 332 of the ink cartridge 1, a surface portion 336 is provided between the first corner portion 334 and the second corner portion 335. The surface portion 336 has an outer surface that is not in parallel with the line L that connects the first corner portion 334 and the second corner portion 335. As shown in FIG. 12, the surface portion 336 connects to the lower end of the rear surface portion 331. Along the rear end portion of the right wall 30 having an inverted L-shape in a side view, the surface portion 336 extends forward and then bends downward, further extending between the two flanges 727 and 728. The flanges 727 and 728 are provided on the outer periphery of the body portion 721 of the spout 72. Further, slightly in front of the rear end of the bottom wall 31, the surface portion 336 extends from the upper surface of the bottom wall 31 (the inner surface of the case 2) to between the two flanges 727 and 728 of the spout 72. The bottom wall 31 extends substantially horizontally on the lower end of the ink cartridge 12, up to a point below the flange 727 (of the two flanges 727 and 728) that is located on the rear end side (the left side in FIG. 12) of the bottom wall 31. Below the flange 727, the bottom surface of the bottom wall 31 connects to an inclined portion 361 that is inclined slightly upward from a substantially horizontally extending portion toward the rear.

In the ink cartridge 12, a corner portion at which the bottom wall 31 and the inclined portion 361 are connected is the first corner portion 334. A corner portion at which the rear surface portion 331 and the surface portion 336 are connected is the second corner portion 335. Both the first corner portion 334 and the second corner portion 335 are obtuse angle corner portions. Although a corner formed by the outer surface (the bottom surface) of the bottom wall 31 and an outer surface of the inclined portion 361, and a corner formed by the outer surface (the rear surface) of the rear surface portion 331 and an outer surface of the surface portion 336 are both obtuse angles, the angles of the corners are different. Specifically, the angle of the first corner portion 334 is larger than the angle of the second corner portion 335.

In a case where the remaining amount of ink becomes small, the ink cartridge 12 can be placed such that the first corner portion 334 and the second corner portion 335 come into contact with a support surface. Therefore, the ink cartridge 12 can be held in an inclined state. As a result, it is possible to effectively collect the ink remaining in the ink bag 71 toward the first opening 701 of the spout 72. Even when the ink cartridge 12 is placed on a material into which the ink cartridge 12 may sink, the first corner portion 334 and the second corner portion 335 are unlikely to become caught up in the material. It is therefore possible to easily change the posture of the ink cartridge 12.

In this example, in order to seal a rear surface lower portion of the case 2 in a state in which the surface portion 336 is in contact with the outer periphery of the body portion 721 of the spout 72, the case 2 may be divided into the body portion 3 and the lid portion along the center line in the right-left direction, instead of using the method of division shown in FIG. 3. The bottom wall 31, the upper wall 32, the rear surface portion 331, the surface portion 336, and the front wall 34 may be provided on each of the body portion 3 and the lid portion. Similarly to the fixing portion 381 (refer to FIG. 5) of the ink cartridge 1, the surface portion 336 has a function to reliably dispose and fix the spout 72 to an accurate position with respect to the case 2. The ink cartridge 12 also has the receiving surface portion 310 similar to that of the ink cartridge 1. For example, when the ink cartridge 12 is pulled out from the inkjet printer 100, there is a case in which the ink cartridge 12 is disposed such that the bottom wall 31 is directed downward. In this type of case, the receiving surface portion 310 may receive the ink that drops from the spout 72, and thus it is possible to reduce a possibility that the ink leaks to the outside of the case 2.

Figure 13:
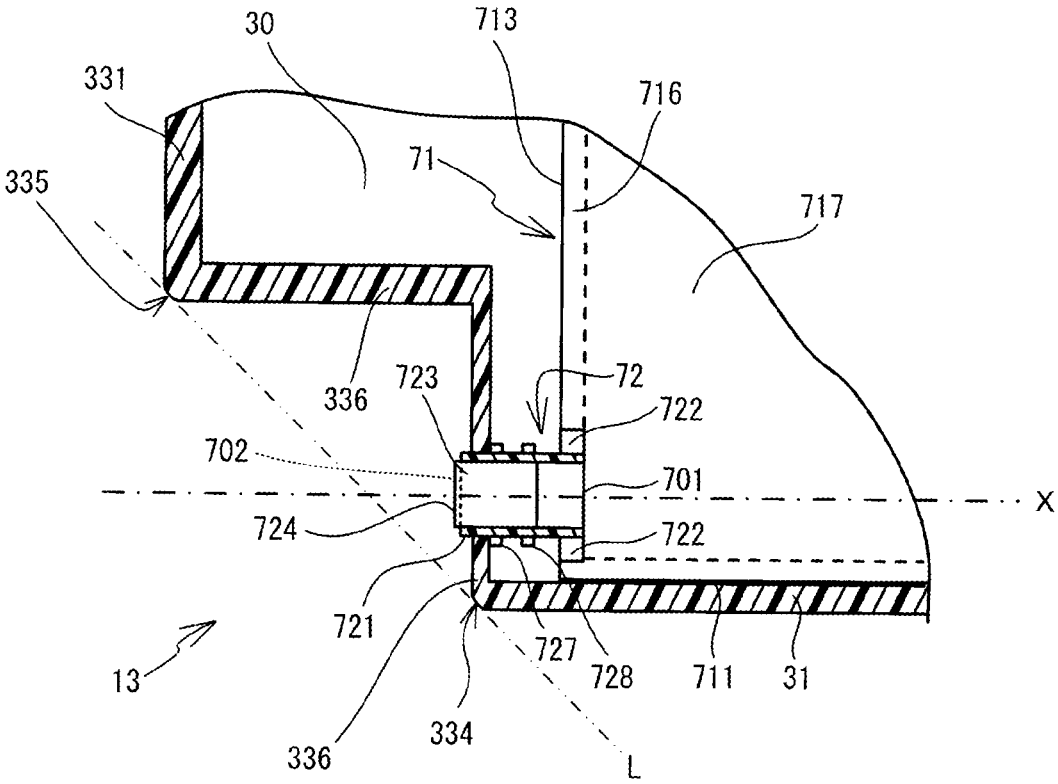
FIG. 13 is an enlarged vertical cross-sectional view of a spout surrounding portion of an ink cartridge according to a third modified example.

An ink cartridge 13 of a third modified example shown in FIG. 13 is the same as the ink cartridge 12 (refer to FIG. 12) of the second modified example in that the surface portion 336 is provided that is continuous with the rear surface portion 331 and the bottom wall 31. However, the ink cartridge 13 is different from the ink cartridge 12 in that the corners of the first corner portion 334 and the second corner portion 335 are rounded off and formed as rounded corner portions, namely, corner portions each having a curved surface. In this manner, even when the corners of the first corner portion 334 and the second corner portion 335 are round, the ink cartridge 13 can be held in an inclined state. As a result, it is possible to effectively collect the ink remaining in the ink bag 71 toward the first opening 701 of the spout 72. Even when the ink cartridge 13 is placed on a material into which the ink cartridge 13 may sink, the first corner portion 334 and the second corner portion 335 are unlikely to be caught up in the material. It is therefore possible to easily change the posture of the ink cartridge 13. Only one of the first corner portion 334 and the second corner portion 335 may be formed as a corner portion having a curved surface and the other corner portion may be formed as a corner portion having one of an acute angle, a right angle, and an obtuse angle.

Figure 14:
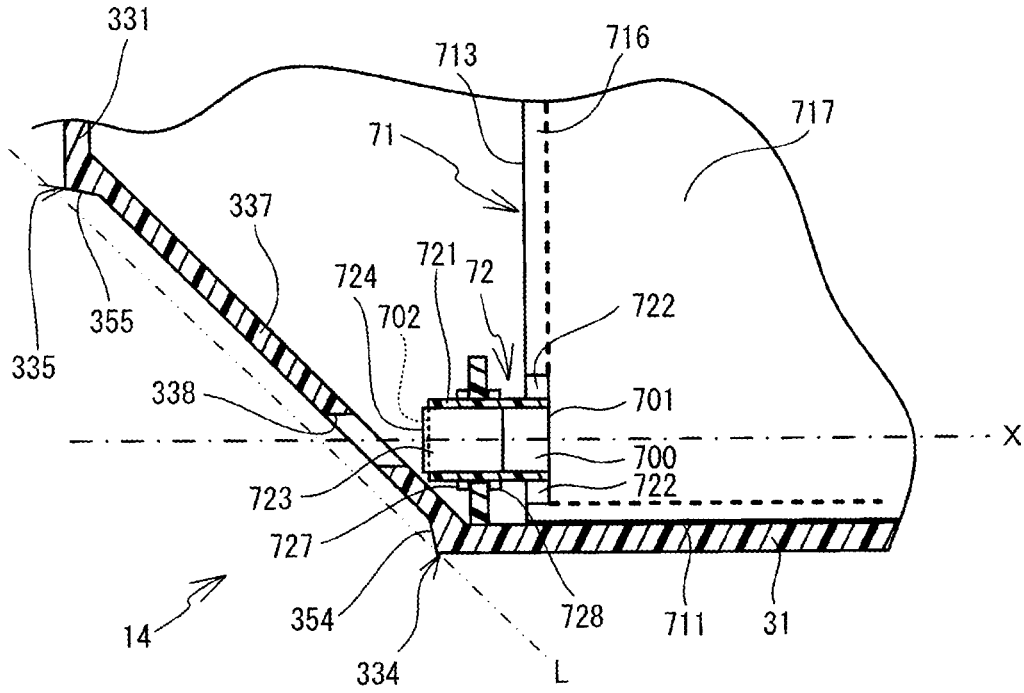
FIG. 14 is an enlarged vertical cross-sectional view of a spout surrounding portion of an ink cartridge according to a fourth modified example.

An ink cartridge 14 of a fourth modified example shown in FIG. 14 is an example in which inclined portions 354 and 355 are provided in place of the stepped portions 351 and 352 of the ink cartridge 1 shown in FIG. 5. As shown in FIG. 5, the stepped portions 351 and 352 of the ink cartridge 1 each have the outer surface that is provided on the inclined surface portion 332 and extends along the line L. The inclined portions 354 and 355 of the ink cartridge 14 are formed by surfaces that are inclined with respect to the line L when viewed from a direction orthogonal to the sheet of FIG. 14. A corner portion at which the rear end of the bottom wall 31 and the inclined portion 354 are connected is the first corner portion 334. A corner portion at which the lower end of the rear surface portion 331 and the inclined portion 355 are connected is the second corner portion 335. Both the first corner portion 334 and the second corner portion 335 are obtuse angle corner portions. Specifically, a corner formed by the outer surface (the bottom surface) of the bottom wall 31 and an outer surface of the inclined portion 354, and a corner formed by the outer surface (the rear surface) of the rear surface portion 331 and an outer surface of the inclined portion 335 are both obtuse angles.

When the amount of remaining ink becomes small, the ink cartridge 14 may be placed such that the first corner portion 334 and the second corner portion 335 come into contact with a support surface. Therefore, the ink cartridge 14 can be held in an inclined state. As a result, it is possible to effectively collect the ink remaining in the ink bag 71 toward the first opening 701 of the spout 72. Even when the ink cartridge 14 is placed on a material into which the ink cartridge 14 may sink, the first corner portion 334 and the second corner portion 335 are unlikely to become caught up in the material. It is therefore possible to easily change the posture of the ink cartridge 14.

On the inner side of the line L that connects the first corner portion 334 and the second corner portion 335, a surface portion 337 that is substantially in parallel with the line L is provided. Therefore, even when the ink cartridge 14 is placed such that the first corner portion 334 and the second corner portion 335 come into contact with a support surface, such as a desk top surface, the penetration portion 338 may not come into contact with the support surface. Therefore, even when ink adheres to the vicinity of the second opening 702, it is possible to reduce a possibility that the ink will adhere to the support surface. The leading end portion 724 of the spout 72 is located inwardly from an outer surface of the surface portion 337. It is therefore possible to protect the spout 72 by the surface portion 337. In the axial line X direction, the leading end portion 724 is located with a clearance from an inner surface (a right surface in FIG. 14) of a lower end portion of the surface portion 337. Therefore, ink can move between the surface portion 337 and the leading end portion 724 (on the lower side of the leading end portion 742 in FIG. 14). On the lower side of the leading end portion 724 shown in FIG. 14, the lower end portion of the surface portion 337 may receive the ink that drops from the spout 72. Thus, it is possible to reduce a possibility that the ink leaks to the outside of the case 2.

In the ink cartridge 14 of the fourth modified example, while the inclined portions 354 and 355 of the surface portion 337 alone remain, a flat surface portion that connects the inclined portions 354 and 355 may be omitted. Similarly, in the ink cartridge 1 of the embodiment shown in FIG. 5, while the stepped portions 351 and 352 of the inclined surface portion 332 alone remain, a flat surface portion that connects the stepped portions 351 and 352 may be omitted. In other words, while the first corner portion 334 and the second corner portion 335 that are obtuse angle corner portions remain, the surface portion need not necessarily be provided between the first corner portion 334 and the second corner portion 335. Also in this type of case, a similar effect can be obtained and the ink remaining in the ink bag 71 can be effectively collected toward the first opening 701 of the spout 72 by using the first corner portion 334 and the second corner portion 335.

Figure 15:
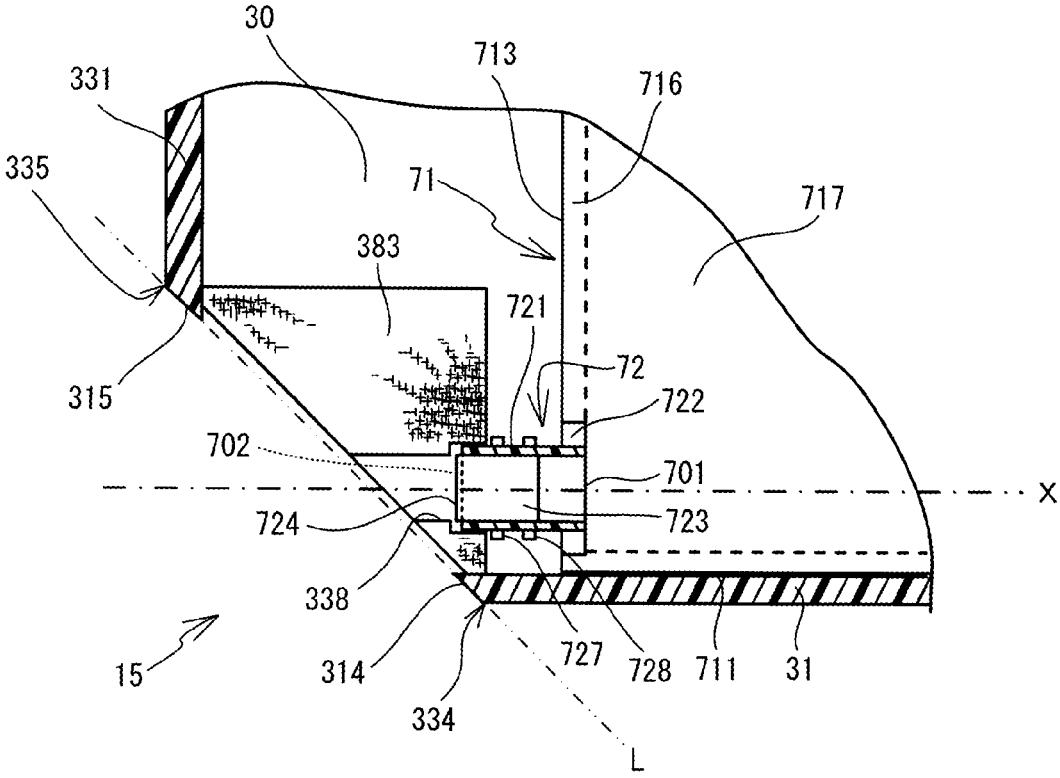
FIG. 15 is an enlarged vertical cross-sectional view of a spout surrounding portion of an ink cartridge according to a fifth modified example.

Similarly to the ink cartridge 1 shown in FIG. 5, an ink cartridge 15 of a fifth modified example shown in FIG. 15 is an example in which, on the inner side of the line L that connects the first corner portion 334 and the second corner portion 335, a surface portion 383 having an outer surface that extends substantially in parallel with the line L is provided. The surface portion 383 is not a surface portion formed continuously with the right wall 30 or the lid portion 4 (refer to FIG. 3). The surface portion 383 is formed such that a felt material formed into a triangular prism shape is filled between the first corner portion 334 and the second corner portion 335. On the inner side of the line L that connects the first corner portion 334 and the second corner portion 335, the outer surface of the surface portion 383 is disposed substantially in parallel with the line L. The surface portion 383 is provided with the penetration portion 338 having an opening diameter that is slightly smaller than an outer diameter of the body portion 721 of the spout 72. An opening diameter of an end portion of the penetration portion 338 on the inner side of the case 2 is widened in accordance with the outer diameter of the body portion 721.

A rear end face 314 of the bottom wall 31 inclines upward toward the rear (the left side in FIG. 15). A lower end face 315 of the rear surface portion 331 inclines downward toward the front. In the ink cartridge 15, a corner portion formed by the outer surface (the bottom surface) of the bottom wall 31 and the rear end face 314 is the first corner portion 334. A corner portion formed by the outer surface (the rear surface) of the rear surface portion 331 and the lower end face 315 is the second corner portion 335. The bottom surface and the rear end face 314 form an obtuse angle, and the rear surface and the lower end face 315 form an obtuse angle.

When the amount of remaining ink becomes small, the ink cartridge 15 may be placed such that the first corner portion 334 and the second corner portion 335 come into contact with a support surface. Therefore, the ink cartridge 15 can be held in an inclined state. Even when the ink cartridge 15 is placed on a material into which the ink cartridge 15 may sink, the first corner portion 334 and the second corner portion 335 are unlikely to become caught up in the material. It is therefore possible to easily change the posture of the ink cartridge 15. In addition, the leading end portion 724 of the spout 72 can be fitted into a section that is provided in the end portion of the penetration portion 338 on the inner side of the case 2 and whose opening diameter is wide. As a result, the spout 72 can be reliably disposed and fixed in an accurate position with respect to the case 2.

Wall surfaces other than the portion that corresponds to the inclined surface portion 332 of the ink cartridge 1 of the embodiment can be omitted, as long as the case 2 includes the first corner portion 334 and the second corner portion 335, and as long as the relationship between the case 2 and the ink pack 7 can be defined as described above. For example, in the ink cartridge, the ink pack 7 may be interposed between the wall surface 30 and the lid portion 4 that face each other, and the outer surfaces of the two layers of sheets forming the ink bag 71 may be partially adhered to the inner surfaces of the right wall 30 and the lid portion 4, respectively, in a range in which the ink bag 71 can expand and contract. In this case, it is preferable to provide the fixing portion 381 (refer to FIG. 11) of the spout 72 in order to reliably fix the spout 72 in an accurate position. In this example, it is possible to maintain the posture of the ink bag 71 in a stable state by the right wall 30 and the lid portion 4 that face each other and between which the ink bag 71 is interposed. When the right wall 30 and the lid portion 4 are formed to have the shapes shown in FIG. 3, even if the bottom wall 31, the rear surface portion 331, and the inclined surface portion 332 are not provided, the first corner portion 334 and the second corner portion 335, which are obtuse corner portions, can be formed at the same positions of the right wall 30 and the lid portion 4. Thus, it is possible to achieve a similar effect to that of the ink cartridge 1 of the embodiment.

When the effect of collecting the ink of the ink cartridge 1 toward the spout 72 is explained above (refer to FIGS. 8 to 10), an example is given in which the user holds the ink cartridge 1 by hand while causing the first corner portion 334 and the second corner portion 335 to come into contact with the substantially horizontal support surface 9. However, the ink cartridge 1 may be caused to stand such that the lower end of the front wall 34 of the ink cartridge 1 is brought into contact with a substantially vertical surface (for example, a wall) indicated by a dashed line Y in FIG. 8, while the first corner portion 334 and the second corner portion 335 are brought into contact with the substantially horizontal support surface 9. In this case, the user need not hold the ink cartridge 1 by hand. In this manner, when the ink cartridge 1 is inclined by leaning the ink cartridge 1 against a wall or the like, there is a possibility that the ink cartridge 1 will be left in this state for a long time (for example, overnight). In other words, a self-standing ability of the ink cartridge 1 in an inclined state causes a possibility that the user will not pay attention to the ink cartridge 1 and the ink cartridge 1 will be left in the inclined state. This is more likely to occur, particularly when the ink cartridge 1 can maintain a stable posture in an inclined state by leaning the ink cartridge 1 against a wall or the like in this manner. For example, in a case where the ink for the ink cartridge 1 contains titanium oxide, if the ink cartridge 1 is left in the inclined state for a long time, titanium oxide may be precipitated downward in the ink bag 71 of the ink cartridge 1. In this case, the ink may be separated into two layers and the ink may become not suitable for printing. As a result, troublesome work may be caused to again perform operations in which the ink is agitated while the ink cartridge 1 is held by hand, and further, the ink cartridge 1 is inclined in order to collect the ink in the vicinity of the spout 72.

To address this, it is sufficient if the ink cartridge 1 is configured such that the ink cartridge 1 does not stand by itself in an inclined state. In this case, if the user removes his or her hand from the ink cartridge 1, the ink cartridge 1 may not maintain the inclined state. As a result, the ink cartridge 1 falls down with the right wall 30 or the lid portion 4 being on the upper side. In addition, if a material, such as a carpet, into which the ink cartridge 1 may sink is used as the support surface 9, since the first corner portion 334 and the second corner portion 335 that come into contact with the support surface 9 have an obtuse angle, the possibility of becoming caught up in the support surface 9 is generally smaller than in a case in which the first corner portion 334 and the second corner portion 335 have an acute angle or a right angle. Therefore, the stability when the ink cartridge 1 is leaned against a wall or the like is lower than in the case in which the first corner portion 334 and the second corner portion 335 have an acute angle or a right angle. As a result, the ink cartridge 1 is more likely to fall down. It is therefore possible to reduce a possibility that the ink cartridge 1 will be left unattended for a long time.

As explained above, the posture of the ink cartridge 1 may be stabilized when the ink cartridge 1 is placed on the support surface 9. In this case, improved efficiency and reduced effort may be achieved, as compared to a case in which the operation to collect ink is performed while the user holds the ink cartridge 1 by the hand in the air. In addition, the ink cartridge 1 is less likely to be left unattended for a long time, as compared to a case in which the first corner portion 334 and the second corner portion 335 have an acute angle or a right angle.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. An ink cartridge comprising:

an ink bag comprising two layers of flexible sheets disposed to face each other to form an ink storage portion configured to store ink inside;

a spout that is provided on the ink bag and that comprises a hollow portion that leads from a first opening to a second opening, wherein the first opening is communicatively connected with the ink storage portion, and the second opening is provided in a leading end portion of the spout and is open to an outside of the ink bag; and a case that houses the ink bag, wherein a longitudinal direction of the case is an axial direction of the spout provided on the ink bag, the case comprising:

an end portion on a side of the second opening of the spout, the end portion comprising:
a first corner portion, and
a second corner portion,
wherein the first corner portion is a corner portion that, in the axial direction, is located on a side of the first opening with respect to the leading end portion of the spout, and
wherein the second corner portion is a corner portion that, in the axial direction, is located on a side opposite to the first opening with respect to the leading end portion of the spout;
wherein:
a width in a first direction is smaller than a width in a second direction in the case, wherein:
the first direction is a direction that is orthogonal to an extending direction of a line connecting the first corner portion and the second corner portion, and to the axial direction, and
the second direction is a direction that is orthogonal to the first direction and to the axial direction,
an axial line of the spout is, in the second direction, located closer to one end portion of the case on a side having the first corner portion,
the leading end portion of the spout is located inside of the case with respect to the line connecting the first corner portion and the second corner portion, and
at least one of:
the first corner portion forms one of an obtuse angle and a curved surface, and
the second corner portion forms one of an obtuse angle and a curved surface, and
wherein the case further comprises:
a third corner portion, and
a fourth corner portion,
wherein the third corner portion is a corner portion located at an end, of the one end portion, opposite to the first corner portion,
wherein the fourth corner portion is a corner portion located at an end, of the end portion, opposite to the first corner portion in the second direction,
wherein an angle of the first corner portion is different from an angle of the third corner portion; and
wherein an angle of the second corner portion is different from an angle of the fourth corner portion.

2. The ink cartridge according to claim 1, wherein:
the first corner portion forms one of an obtuse angle and a curved surface, and
the second corner portion forms one of an obtuse angle and a curved surface.

3. The ink cartridge according to claim 1, wherein the case further comprises:
a surface portion that connects to the first corner portion and the second corner portion and that extends substantially in parallel with the line connecting the first corner portion and the second corner portion; and
a penetration portion that is provided in the surface portion at a position facing the second opening of the spout,
wherein an outer surface of the surface portion is on an inner side of the line connecting the first corner portion and the second corner portion.

4. The ink cartridge according to claim 1, wherein the case further comprises a fixing portion that fixes the spout to the case.

5. The ink cartridge according to claim 1, wherein the case includes no surface portion that is disposed on the line connecting the first corner portion and the second corner portion.

6. The ink cartridge according to claim 1, wherein the case further comprises:
a first side surface that faces one of the two layers of flexible sheets of the ink bag; and
a second side surface that faces the other of the two layers of flexible sheets and that faces the first side surface,
wherein:
the ink bag is interposed between the first side surface and the second side surface,
the first side surface and the second side surface are disposed to be separated from each other in the first direction, and
a distance between the first side surface and the second side surface is shorter than a width of each of the first side surface and the second side surface in the second direction.

7. The ink cartridge according to claim 1, wherein the ink is a pigment ink that contains titanium oxide as a pigment.

8. The ink cartridge according to claim 1, wherein an axial line of the spout is arranged, in the second direction, to intersect the end portion of the case at a point closer to the first corner portion than the second corner portion.

9. An ink cartridge comprising:
an ink bag comprising two layers of flexible sheets disposed to face each other to form an ink storage portion configured to store ink inside;
a spout that is provided on the ink bag and that comprises a hollow portion that leads from a first opening to a second opening, wherein the first opening is communicatively connected with the ink storage portion, and the second opening is provided in a leading end portion of the spout and is open to an outside of the ink bag; and
a case that houses the ink bag, wherein a longitudinal direction of the case is an axial direction of the spout provided on the ink bag, the case comprising:
an end portion on a side of the second opening of the spout, the end portion comprising:
a first corner portion, and
a second corner portion,
wherein the first corner portion is a corner portion that, in the axial direction, is located on a side of the first opening with respect to the leading end portion of the spout, and
wherein the second corner portion is a corner portion that, in the axial direction, is located on a side opposite to the first opening with respect to the leading end portion of the spout;
wherein:
a width in a first direction is smaller than a width in a second direction in the case, wherein:
the first direction is a direction that is orthogonal to an extending direction of a line connecting the first corner portion and the second corner portion, and to the axial direction, and
the second direction is a direction that is orthogonal to the first direction and to the axial direction,
an axial line of the spout is, in the second direction, located closer to one end portion of the case on a side having the first corner portion,
the leading end portion of the spout is located inside of the case with respect to the line connecting the first corner portion and the second corner portion, and
at least one of the first corner portion and the second corner portion forms an obtuse angle, and
wherein the case further comprises:
a third corner portion, and
a fourth corner portion, wherein the third corner portion is a corner portion located at an end, of the one end portion, opposite to the first corner portion, wherein the fourth corner portion is a corner portion located at an end, of the end portion, opposite to the first corner portion in the second direction, wherein an angle of the first corner portion is different from an angle of the third corner portion; and wherein an angle of the second corner portion is different from an angle of the fourth corner portion.

10. The ink cartridge according to claim 9, wherein:

the first corner portion forms an obtuse angle, and the second corner portion forms an obtuse angle.

11. The ink cartridge according to claim 9, wherein the case further comprises:

a surface portion that connects to the first corner portion and the second corner portion and that extends substantially in parallel with the line connecting the first corner portion and the second corner portion; and a penetration portion that is provided in the surface portion at a position facing the second opening of the spout, wherein an outer surface of the surface portion is on an inner side of the line connecting the first corner portion and the second corner portion.

12. The ink cartridge according to claim 9, wherein the case further comprises a fixing portion that fixes the spout to the case.

13. The ink cartridge according to claim 9, wherein the case includes no surface portion that is disposed on the line connecting the first corner portion and the second corner portion.

14. The ink cartridge according to claim 9, wherein the case further comprises:

a first side surface that faces one of the two layers of flexible sheets of the ink bag; and a second side surface that faces the other of the two layers of flexible sheets and that faces the first side surface, wherein:

the ink bag is interposed between the first side surface and the second side surface, the first side surface and the second side surface are disposed to be separated from each other in the first direction, and a distance between the first side surface and the second side surface is shorter than a width of each of the first side surface and the second side surface in the second direction.

15. The ink cartridge according to claim 9, wherein the ink is a pigment ink that contains titanium oxide as a pigment.

16. The ink cartridge according to claim 9, wherein the at least one of the first corner portion and the second corner portion forming an obtuse angle forms a curved surface.

17. The ink cartridge according to claim 9, wherein an axial line of the spout is arranged, in the second direction, to intersect the end portion of the case at a point closer to the first corner portion than the second corner portion.

* * * * *